US010115409B2

(12) United States Patent
Lee et al.

(10) Patent No.: US 10,115,409 B2
(45) Date of Patent: Oct. 30, 2018

(54) ADAPTIVE PROCESSING OF SOUND DATA

(71) Applicant: Samsung Electronics Co., Ltd., Gyeonggi-do (KR)

(72) Inventors: Nam-Il Lee, Gyeonggi-do (KR); Nam-Woog Lee, Gyeonggi-do (KR); Keun-Won Jang, Gyeonggi-do (KR); Ho-Chul Hwang, Seoul (KR)

(73) Assignee: Samsung Electronics Co., Ltd (KR)

( * ) Notice: Subject to any disclaimer, the term of this patent is extended or adjusted under 35 U.S.C. 154(b) by 58 days.

(21) Appl. No.: 15/207,777

(22) Filed: Jul. 12, 2016

(65) Prior Publication Data

US 2017/0047077 A1 Feb. 16, 2017

(30) Foreign Application Priority Data

Aug. 11, 2015 (KR) ..... 10-2015-0113427

(51) Int. Cl.
*G10L 21/00* (2013.01)
*G10L 25/00* (2013.01)
(Continued)

(52) U.S. Cl.
CPC ..... *G10L 19/22* (2013.01); *G10L 19/20* (2013.01); *G10L 25/81* (2013.01)

(58) Field of Classification Search
CPC ..... G10L 19/12; G10L 19/22; G10L 19/20; G10L 19/24; G10L 19/002
(Continued)

(56) References Cited

U.S. PATENT DOCUMENTS 8,688,442 B2 * 4/2014 Miyasaka ..... G10L 19/0212 704/200
2011/0137663 A1 6/2011 Beack et al.
(Continued)

FOREIGN PATENT DOCUMENTS

EP 2 491 555 8/2012
KR 1020100007749 1/2010
(Continued)

OTHER PUBLICATIONS

Jongho Kim et al., "Blind Classification of Speech Compression Methods using Structural Analysis of Bitstreams", XP055327322, Journal of the Korea Institute of Information and Communication Engineering, Jan. 1, 2012, 6 pages.
(Continued)

*Primary Examiner* — Charlotte M Baker
(74) *Attorney, Agent, or Firm* — The Farrell Law Firm, P.C.

(57) ABSTRACT

A method and electronic device for adaptive processing of sound data is provided. An electronic device includes a speaker, a communication module configured to communicate with an external electronic device, and a processor connected to the communication module, wherein the processor is configured to receive data from the external electronic device using the communication module, when the data corresponds to speech, decode the data using a first decoding scheme and change the quality of the decoded data using a first signal processing scheme, when the data corresponds to music, decode the data using a second decoding scheme and change the quality of the decoded data using a second signal processing scheme, and output, through the speaker, an audio signal corresponding to the data changed using the first signal processing scheme or the second signal processing scheme.

14 Claims, 15 Drawing Sheets

(51) Int. Cl.
*G10L 19/22* (2013.01)
*G10L 25/81* (2013.01)
*G10L 19/20* (2013.01)

(58) Field of Classification Search
USPC ..... 704/500, 220, 230, E19.019, 229, 200, 704/501; 375/E7.271
See application file for complete search history.

(56) References Cited

U.S. PATENT DOCUMENTS

| | | | | |
|---|---|---|---|---|
| 2013/0185063 | A1 | 7/2013 | Atti et al. | |
| 2016/0293174 | A1* | 10/2016 | Atti | G10L 19/26 |
| 2016/0372127 | A1* | 12/2016 | Chebiyyam | G06F 7/588 |

FOREIGN PATENT DOCUMENTS

| | | |
|---|---|---|
| KR | 1020100032843 | 3/2010 |
| KR | 100972159 | 7/2010 |
| KR | 1020120137313 | 12/2012 |
| WO | WO 2010/040522 | 4/2010 |
| WO | WO 2011/048094 | 4/2011 |

OTHER PUBLICATIONS

European Search Report dated Jan. 20, 2017 issued in counterpart application No. 16182492.5-1901, 9 pages.

* cited by examiner

ADAPTIVE PROCESSING OF SOUND DATA

PRIORITY

This application claims priority under 35 U.S.C. § 119(a) to Korean Patent Application Serial No. 10-2015-0113427, which was filed in the Korean Intellectual Property Office on Aug. 11, 2015, the entire content of which is incorporated herein by reference.

BACKGROUND

1. Field of the Disclosure

The present disclosure generally relates to an adaptive processing of sound data.

2. Description of the Related Art

Second, third and fourth generation technologies coexist in the mobile communication system, and each of the techniques has been developed with different speeds and cycles.

A second-generation global system for mobile communications (GSM) technology has used 4 kHz (narrow band) of call frequency bands, and thereafter, a wideband code division multiple access (WCDMA) technology has used 8 kHz (wide band) of extended call frequency bands. Recently, since the call frequency band is extended from the speech band (8 kHz) of the previous generation to 16 kHz (super wide band) and to 24 kHz (full band) by using an enhanced voice services (EVS) technology, many processing technologies and methods for the call quality including audio bands are needed.

As described above, the related art may perform signal processing for an audio signal using a high tone of call frequency bands based on the EVS technology.

However, in the related art, since the signal processing is performed without distinction as to whether the audio signal during the call is speech or music, high tones are excessively filtered when the audio signal includes music which has high tones exceeding the speech band so that sound quality degradation may occur.

SUMMARY

Various aspects of the present disclosure provide an electronic device for processing an audio signal according to adaptive processing of sound data and a method therefor.

Various aspects of the present disclosure may analyze whether the audio signal is speech or music and perform an appropriate process depending on the speech or music so as to improve an articulation of the audio signal and uniformly reproduce the full band of the audio signal.

According to an aspect of the present disclosure, an electronic device is provided. The electronic device includes a speaker, a communication module configured to communicate with an external electronic device, and a processor functionally connected to the communication module, wherein the processor is configured to receive data from the external electronic device by using the communication module, when the data corresponds to speech, decode the data by using a first decoding scheme and change the speech quality of the decoded data by using a first signal processing scheme, when the data corresponds to music, decode the data by using a second decoding scheme and change the speech quality of the decoded data by using a second signal processing scheme, and output, through the speaker, an audio signal corresponding to the data changed using a signal processing method corresponding to either the first signal processing scheme or the second signal processing scheme.

According to another aspect of the present disclosure, a method performed by an electronic device is provided. The method includes receiving data from an external electronic device, when the data corresponds to speech, decoding the data by using a first decoding scheme and changing the speech quality of the decoded data by using a first signal processing method, when the data corresponds to music, decoding the data by using a second decoding scheme and changing the speech quality of the decoded data by using a second signal processing method, and outputting, through an output device, an audio signal corresponding to the data changed using a signal processing method corresponding to either the first signal processing method or the second signal processing method.

According to another aspect of the present disclosure, an electronic device includes, a microphone, a communication module configured to communicate with an external electronic device, and a processor functionally connected to the communication module, wherein the processor is configured to, receive an audio signal through the microphone, generate data corresponding to the audio signal, determine attributes of the audio signal at least partially based on the data, when the audio signal corresponds to speech, change the speech quality of the data by using a first signal processing method and encode the changed data by using a first coding scheme, when the audio signal corresponds to music, change the speech quality of the data by using a second signal processing method and encode the changed data by using a second coding scheme, and transmit, to the external electronic device through a communication module, the audio signal which has been encoded using a coding scheme corresponding to either the first coding scheme or the second coding scheme.

According to another aspect of the present disclosure, a method performed by an electronic device is provided. The method includes, receiving an audio signal from an input device, generating data corresponding to the audio signal, determining attributes of the audio signal at least partially based on the data, when the audio signal corresponds to speech, changing the speech quality of the data by using a first signal processing method and encoding the changed data by using a first coding scheme, when the audio signal corresponds to music, changing the speech quality of the data by using a second signal processing method and encoding the changed data by using a second coding scheme, and transmitting, to an external electronic device through a communication module, the audio signal which has been encoded using a coding scheme corresponding to the first coding scheme or the second coding scheme.

BRIEF DESCRIPTION OF THE DRAWINGS

The above and other aspects, features, and advantages of the present disclosure will be more apparent from the following detailed description taken in conjunction with the accompanying drawings, in which.

DETAILED DESCRIPTION

Figure 1:
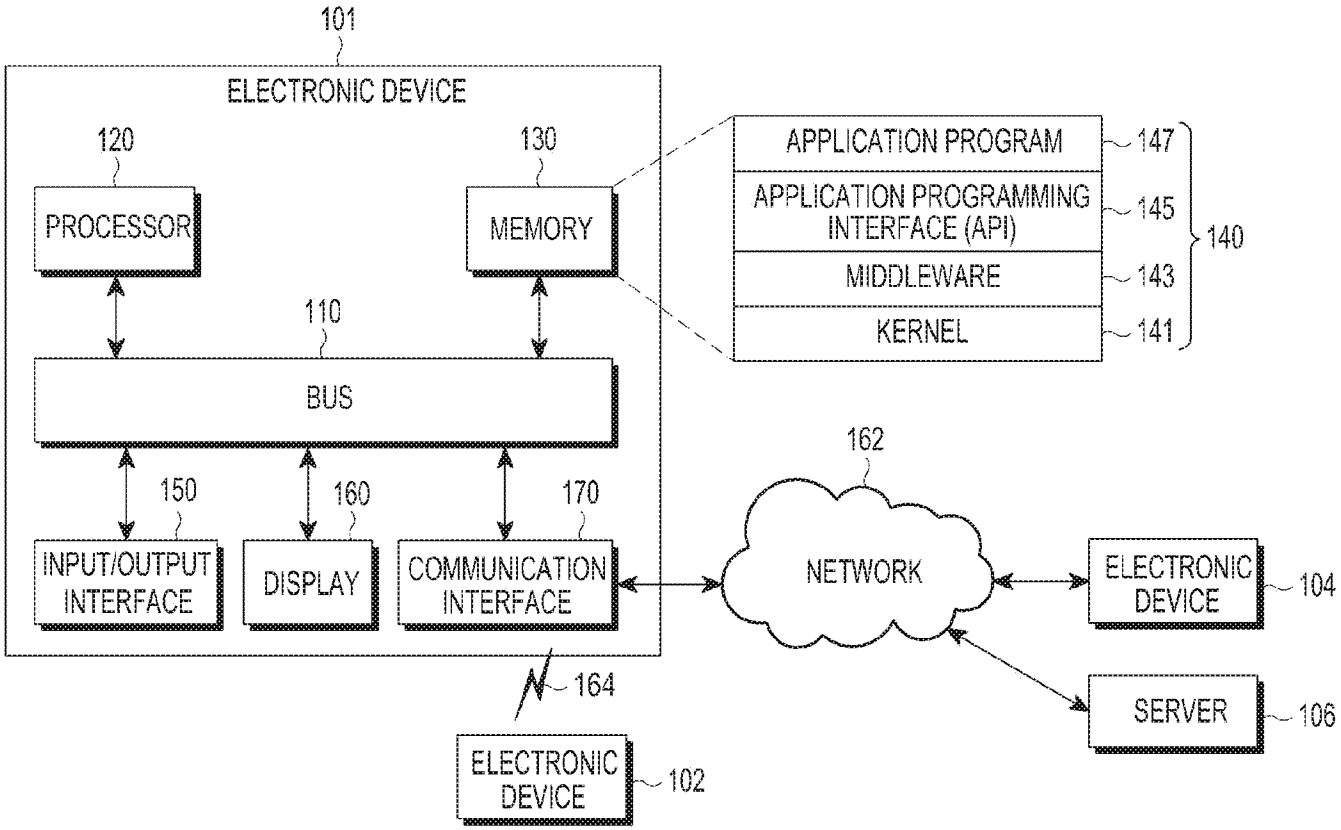
FIG. 1 illustrates a network environment including an electronic device according to various embodiments of the present disclosure.

Hereinafter, various embodiments of the present disclosure will be described with reference to the accompanying drawings. However, it should be understood that there is no limiting the present disclosure to the particular forms disclosed herein, rather, the present disclosure should be construed to cover various modifications, equivalents, and/or alternatives of embodiments of the present disclosure. In describing the drawings, similar reference numerals may be used to designate similar constituent elements.

As used herein, the expressions "have", "may have", "include", or "may include" refer to the existence of a corresponding feature (e.g., numeral, function, operation, or constituent element such as component), and do not exclude one or more additional features.

In the present disclosure, the expressions "A or B", "at least one of A or/and B", or "one or more of A or/and B" may include all possible combinations of the items listed. For example, the expressions "A or B", "at least one of A and B", or "at least one of A or B" refer to all of (1) including at least one A, (2) including at least one B, or (3) including all of at least one A and at least one B.

The expressions "a first", "a second", "the first", or "the second" used in various embodiments of the present disclosure may modify various components regardless of the order and/or the importance but do not limit the corresponding components. For example, a first user device and a second user device may indicate different user devices although both of them are user devices. For example, a first element may be referred to as a second element, and similarly, a second element may be referred to as a first element without departing from the scope of the present disclosure.

It should be understood that when an element (e.g., first element) is referred to as being (operatively or communicatively) "connected," or "coupled," to another element (e.g., second element), it may be directly connected or coupled directly to the other element or any other element (e.g., third element) may be interposed between them. In contrast, it may be understood that when an element (e.g., first element) is referred to as being "directly connected," or "directly coupled" to another element (second element), there are no elements (e.g., third element) interposed between them.

The expressions "configured to" used in the present disclosure may be used interchangeably with, for example, "suitable for", "having the capacity to", "designed to", "adapted to", "made to", or "capable of" according to the situation. The term "configured to" may not necessarily imply "specifically designed to" in hardware. Alternatively, in some situations, the expression "device configured to" may mean that the device, together with other devices or components, "is able to". For example, the phrase "processor adapted (or configured) to perform A, B, and C" may mean a dedicated processor (e.g. embedded processor) only for performing the corresponding operations or a general-purpose processor (e.g., central processing unit (CPU) or application processor (AP)) that may perform the corresponding operations by executing one or more software programs stored in a memory device.

The terms used in the present disclosure are only used to describe specific embodiments, and do not limit the present disclosure. As used herein, singular forms may include plural forms as well unless the context clearly indicates otherwise. Unless defined otherwise, all terms used herein, including technical and scientific terms, have the same meaning as those commonly understood by a person skilled in the art to which the present disclosure pertains. Such terms as those defined in a generally used dictionary may be interpreted to have the same meanings as the contextual meanings in the relevant field of art, and are not to be interpreted to have ideal or excessively formal meanings unless clearly defined in the present disclosure. In some cases, even terms defined in the present disclosure should not be interpreted to exclude embodiments of the present disclosure.

An electronic device according to various embodiments of the present disclosure may include at least one of, for example, a smart phone, a tablet personal computer (PC), a mobile phone, a video phone, an electronic book reader (e-book reader), a desktop PC, a laptop PC, a netbook computer, a workstation, a server, a personal digital assistant (PDA), a portable multimedia player (PMP), a MPEG-1 audio layer-3 (MP3) player, a mobile medical device, a camera, and a wearable device. The wearable device may include at least one of an accessory type (e.g., a watch, a ring, a bracelet, an anklet, a necklace, a glasses, a contact lens, or a head-mounted device (HMD)), a fabric or clothing integrated type (e.g., an electronic clothing), a bodymounted type (e.g., a skin pad, or tattoo), and a bio-implantable type (e.g., an implantable circuit).

According to some embodiments, the electronic device may be a home appliance. The home appliance may include at least one of, for example, a television, a digital video disk (DVD) player, an audio player, a refrigerator, an air conditioner, a vacuum cleaner, an oven, a microwave oven, a washing machine, an air cleaner, a set-top box, a home automation control panel, a security control panel, a TV box (e.g., Samsung HomeSync™, Apple TV™, or Google TV™), a game console (e.g., Xbox™ and PlayStation™), an electronic dictionary, an electronic key, a camcorder, and an electronic photo frame.

According to another embodiment, the electronic device may include at least one of various medical devices (e.g., various portable medical measuring devices (a blood glucose monitoring device, a heart rate monitoring device, a blood pressure measuring device, a body temperature measuring device, etc.), a magnetic resonance angiography (MRA), a Magnetic Resonance Imaging (MRI), a computed tomography (CT) machine, and an ultrasonic machine), a navigation device, a global positioning system (GPS) receiver, an event data recorder (EDR), a Flight Data Recorder (FDR), a vehicle infotainment devices, an electronic devices for a ship (e.g., a navigation device for a ship, and a gyro-compass), avionics, security devices, an automotive head unit, a robot for home or industry, an automatic teller machine (ATM), point of sales (POS) terminal, or Internet of Things device (e.g., a light bulb, various sensors, electric or gas meter, a sprinkler device, a fire alarm, a thermostat, a streetlamp, a toaster, a sporting good, a hot water tank, a heater, a boiler, etc.).

According to some embodiments, the electronic device may include at least one of a part of furniture or a building/structure, an electronic board, an electronic signature receiving device, a projector, and various kinds of measuring instruments (e.g., a water meter, an electric meter, a gas meter, and a radio wave meter). The electronic device may be a combination of one or more of the aforementioned various devices. The electronic device may be a flexible device. Further, the electronic device is not limited to the aforementioned devices, and may include a new electronic device according to the development of new technology.

Hereinafter, an electronic device according to various embodiments of the present disclosure will be described with reference to the accompanying drawings. In the present disclosure, the term "user" may indicate a person using an electronic device or a device (e.g. an artificial intelligence electronic device) using an electronic device.

The electronic device 101 in a network environment 100 according to various embodiments will be described with reference to FIG. 1. The electronic device 101 includes a bus 110, a processor 120, a memory 130, an input/output interface 150, a display 160, and a communication interface 170. In some embodiments, the electronic device 101 may omit at least one of the elements, or may further include other elements.

The bus 110 may include, for example, a circuit for connecting the elements 110 to 170 and transferring communication (for example, control messages and/or data) between the elements.

The processor 120 may include one or more of a central processor unit (CPU), an application processor (AP), and a communication processor (CP). For example, the processor 120 may carry out operations or data processing relating to control and/or communication of at least one other element of the management device 101. The processor 120 may be referred to as a controller, or include the controller as a part thereof, or configure the controller.

The memory 130 may include a volatile memory and/or a non-volatile memory. The memory 130 may store, for example, instructions or data relevant to at least one other element of the electronic device 101. According to an embodiment, the memory 130 may store software and/or a program 140. The program 140 includes a kernel 141, middleware 143, an application programming interface (API) 145, and/or application programs (or "applications") 147. At least some of the kernel 141, the middleware 143, and the API 145 may be referred to as an operating system (OS).

For example, the kernel 141 may control or manage system resources (for example, the bus 110, the processor 120, and the memory 130) which are used to execute an operation or a function implemented in the other programs (for example, the middleware 143, the API 145, and the application programs 147). Furthermore, the kernel 141 may provide an interface through which the middleware 143, the API 145, or the application programs 147 may access the individual elements of the electronic device 101 to control or manage the system resources.

The middleware 143, for example, may function as an intermediary for allowing the API 145 or the application programs 147 to communicate with the kernel 141 to exchange data.

In addition, the middleware 143 may process one or more task requests received from the application programs 147 according to priorities thereof For example, the middleware 143 may assign priorities for using the system resources (for example, the bus 110, the processor 120, the memory 130, and the like) of the electronic device 101, to at least one of the application programs 147. For example, the middleware 143 may perform scheduling or load balancing on the one or more task requests by processing the one or more task requests according to the priorities assigned thereto.

The API 145 is an interface by which the applications 147 control functions provided from the kernel 141 or the middleware 143, and may include, for example, at least one interface or function (e.g., an instruction) for file control, window control, image processing, or text control.

The input/output interface 150 may function as, for example, an interface that may transfer instructions or data input from a user or another external device to the other element(s) of the electronic device 101. Also, the input/output interface 150 may output instructions or data received from other element(s) of the electronic device 101 to the user or another external device.

Examples of the display 160 may include a liquid crystal display (LCD), a light-emitting diode (LED) display, an organic light-emitting diode (OLED) display, a microelectromechanical systems (MEMS) display, and an electronic paper display. The display 160 may display, for example, various types of content (for example, text, images, videos, icons, or symbols) to the user. The display 160 may include a touch screen and receive, for example, a touch input, a gesture input, a proximity input, or a hovering input using an electronic pen or a user's body part.

The communication interface 170 may set communication between, for example, the electronic device 101 and an external device (for example, a first external electronic device 102, a second external electronic device 104, or a server 106). For example, the communication interface 170 may be connected to a network 162 through wireless or wired communication to communicate with the external device (for example, the second external electronic device 104 or the server 106).

According to an embodiment, the communication interface 170 may receive a personal profile and/or a group profile from the first external electronic device 102, the second external electronic device 104, or the server 106 or transmit the personal profile and/or the group profile to the external device.

The wireless communication may use at least one of, for example, long term evolution (LTE), LTE-advance (LTE-A), code division multiple access (CDMA), Wideband CDMA (WCDMA), universal mobile telecommunications system (UMTS), WiBro (wireless broadband), and global system for mobile communications (GSM), as a cellular communication protocol. In addition, the wireless communication may include, for example, short range communication 164. The short-range communication 164 may be performed using at least one of, for example, Wi-Fi, Bluetooth, near field communication (NFC), and global navigation satellite system (GNSS). The GNSS may include at least one of, for example, a global positioning System (GPS), a global navigation satellite system (Glonass), a Beidou navigation satellite system ("Beidou"), and a European global satellite-based navigation system (Galileo), according to a use area, a bandwidth, and the like. Hereinafter, in the present disclosure, the term "GPS" may be interchangeably used with the term "GNSS". The wired communication may include at least one of, for example, a universal serial bus (USB), a high definition multimedia interface (HDMI), recommended standard 232 (RS-232), and a plain old telephone service (POTS). The network 162 may include at least one of communication networks such as a computer network (for example, a LAN or a WAN), the Internet, and a telephone network.

Each of the first and second external electronic devices 102 and 104 may be a device which is the same as, or different from, the electronic device 101.

According to an embodiment, the server 106 may include a group of one or more servers.

According to various embodiments, all or some of the operations performed by the electronic device 101 may be performed by another electronic device or a plurality of electronic devices (for example, the electronic devices 102 and 104 or the server 106).

According to an embodiment, when the electronic device 101 has to perform a function or service automatically or in response to a request, the electronic device 101 may request another device 102, 104, or the server 106 to perform at least some functions relating thereto, instead of autonomously or additionally performing the function or service. Another electronic device 102, 104, or the server 106 may execute the requested functions or the additional functions, and may deliver a result of the execution to the electronic device 101. The electronic device 101 may process the received result as it is or additionally to provide the requested functions or services. To achieve this, for example, cloud computing, distributed computing, or client-server computing technology may be used.

Figure 2:
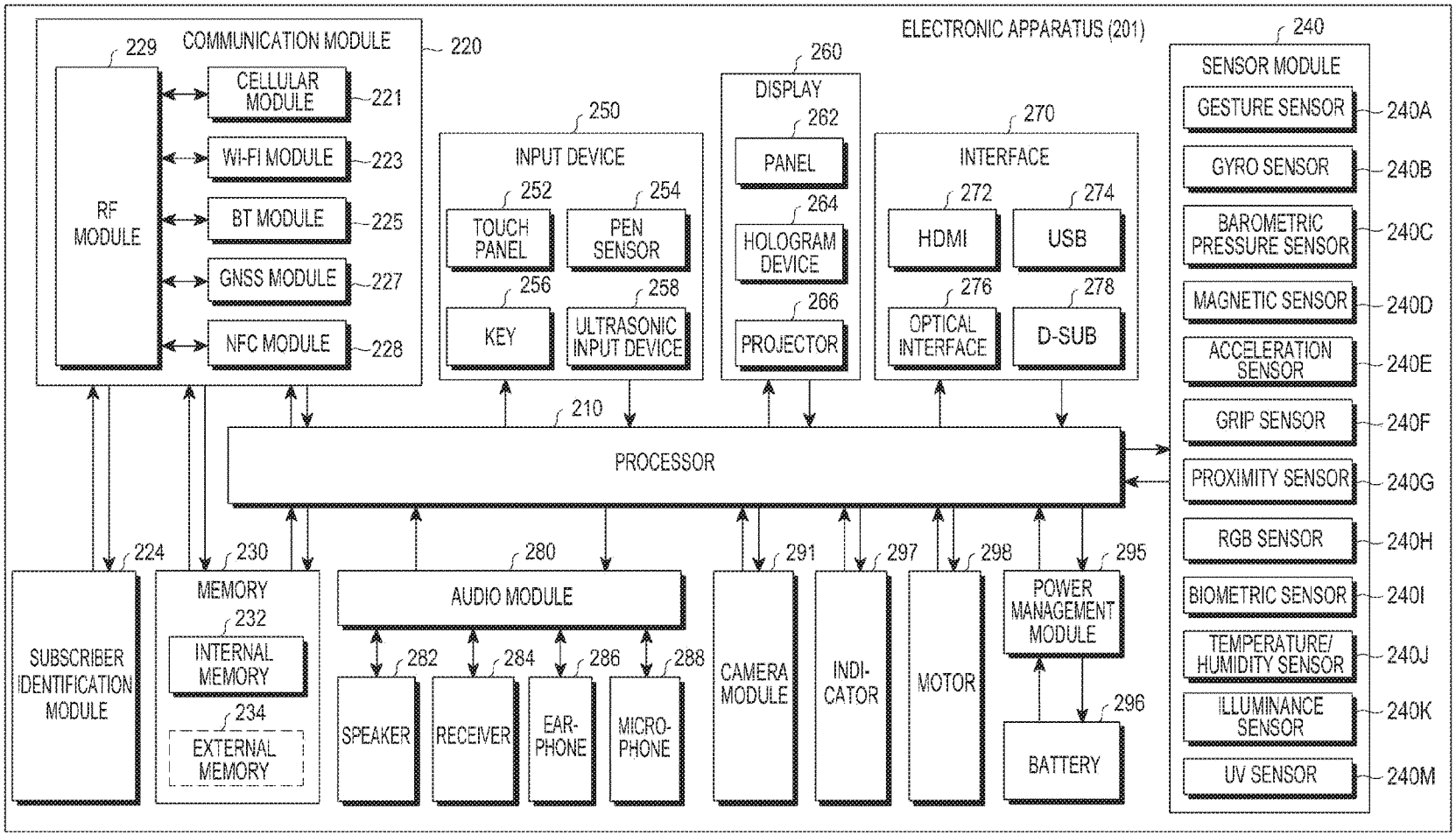
FIG. 2 is a block diagram of an electronic device according to various embodiments of the present disclosure.

FIG. 2 is a block diagram of an electronic device according to various embodiments. The electronic device 201 may include, for example, the whole or part of the electronic device 101 illustrated in FIG. 1. The electronic device 201 includes at least one application processor (AP) 210, a communication module 220, a subscriber identification module (SIM) card 224, a memory 230, a sensor module 240, an input device 250, a display 260, an interface 270, an audio module 280, a camera module 291, a power management module 295, a battery 296, an indicator 297, and a motor 298.

The processor 210 may control multiple hardware or software elements connected to the processor 210 by running, for example, an operation system (OS) or an application program, and may perform processing of and arithmetic operations on various data. The processor 210 may be implemented by, for example, a system on chip (SoC). The processor 210 may further include a graphic processor (GPU) and/or an image signal processor. The processor 210 may include at least some (for example, a cellular module 221) of the elements illustrated in FIG. 2. The processor 210 may load, into a volatile memory, instructions or data received from at least one (for example, a non-volatile memory) of the other elements and may process the loaded instructions or data, and may store various data in a non-volatile memory.

According to an embodiment of the present disclosure, the processor 210 may convert an audio signal input through the microphone 288 into audio data, determine whether the audio data corresponds to speech or music by analyzing the audio data, perform pre-processing and encoding corresponding to the speech or music based on the result of the determination, and then control the audio module 280 so as to output the encoded audio data. In addition, the processor 210 may control the audio module 280 so as to analyze the encoded audio data received through the communication module 220 to determine whether the analyzed audio data corresponds to speech or music, perform decoding and post-processing of the speech or music according to the result of the determination, and then output the processed audio data through the speaker 282.

The communication module 220 may have a configuration identical or similar to that of the communication interface 170 illustrated in FIG. 1. The communication circuit 220 includes a cellular module 221, a Wi-Fi module 223, a BT module 225, a GNSS module 227 (for example, a GPS module, a Glonass module, a Beidou module, or a Galileo module), an NFC module 228, and a radio frequency (RF) module 229.

The cellular module 221 may provide a speech call, an image call, a text message service, or an Internet access service through, for example, a communication network. According to an embodiment, the cellular module 221 may identify and authenticate the electronic device 201 within a communication network using a subscriber identification module (for example, the SIM card 224). The cellular module 221 may perform at least some of the functions that the AP 210 may provide. The cellular module 221 may include a communication processor (CP).

The Wi-Fi module 223, the Bluetooth module 225, the GNSS module 227, or the NFC module 228 may include, for example, a processor that processes data transmitted and received through the corresponding module. In some embodiments, at least some (two or more) of the cellular module 221, the Wi-Fi module 223, the Bluetooth module 225, the GNSS module 227, and the NFC module 228 may be included in a single integrated chip (IC) or IC package.

The RF module 229 may transmit/receive, for example, a communication signal (for example, an RF signal). The RF module 229 may include, for example, a transceiver, a power amplifier module (PAM), a frequency filter, a low noise amplifier (LNA), and an antenna. According to another embodiment, at least one of the cellular module 221, the Wi-Fi module 223, the Bluetooth module 225, the GNSS module 227, and the NFC module 228 may transmit/receive an RF signal through a separate RF module.

The subscriber identification module 224 may include, for example, a card including an embedded SIM, and may contain unique identification information (for example, an integrated circuit card identifier (ICCID)) or subscriber information (for example, an international mobile subscriber identity (IMSI)).

The memory 230 (for example, the memory 130) includes an internal memory 232 or an external memory 234. The internal memory 232 may include at least one of a volatile memory (for example, a Dynamic Random Access Memory (DRAM), a static RAM (SRAM), a synchronous dynamic RAM (SDRAM), and the like) and a non-volatile memory (for example, a one time programmable read only memory (OTPROM), a programmable ROM (PROM), an erasable and programmable ROM (EPROM), an electrically erasable and programmable ROM (EEPROM), a mask ROM, a flash ROM, a flash memory (for example, a NAND flash memory or a NOR flash memory), a hard disk drive, a solid state drive (SSD), and the like).

The external memory 234 may further include a flash drive, for example, a compact flash (CF), a secure digital (SD), a micro secure digital (Micro-SD), a mini secure digital (Mini-SD), an extreme Digital (xD), a multi-media card (MMC), a memory stick, and the like. The external memory 234 may be functionally and/or physically connected to the electronic device 201 through various interfaces.

The sensor module 240 may measure a physical quantity or detect an operation state of the electronic device 201, and may convert the measured or detected information into an electrical signal. The sensor module 240 includes at least one of a gesture sensor 240A, a gyro sensor 240B, an atmospheric pressure sensor 240C, a magnetic sensor 240D, an acceleration sensor 240E, a grip sensor 240F, a proximity sensor 240G, a color sensor 240H (for example, a red, green, blue (RGB) sensor), a biometric sensor 240I, a temperature/humidity sensor 240J, a light sensor 240K, and a ultraviolet (UV) sensor 240M. Additionally or alternatively, the sensor module 240 may include, for example, an E-nose sensor, an electromyography (EMG) sensor, an electroencephalogram (EEG) sensor, an electrocardiogram (ECG) sensor, an infrared (IR) sensor, an iris sensor, and/or a fingerprint sensor. The sensor module 240 may further include a control circuit for controlling one or more sensors included therein. In some embodiments, the electronic device 201 may further include a processor, which is configured to control the sensor module 240, as a part of the processor 210 or separately from the processor 210 in order to control the sensor module 240 while the processor 210 is in a sleep state.

The input device 250 includes a touch panel 252, a (digital) pen sensor 254, a key 256, and an ultrasonic input unit 258. The touch panel 252 may use at least one of, for example, a capacitive type, a resistive type, an infrared type, and an ultrasonic type. Also, the touch panel 252 may further include a control circuit. The touch panel 252 may further include a tactile layer and provide a tactile reaction to the user.

The (digital) pen sensor 254 may include, for example, a recognition sheet which is a part of the touch panel or is separated from the touch panel. The key 256 may include, for example, a physical button, an optical key or a keypad. The ultrasonic input device 258 may detect ultrasonic waves generated by an input tool through a microphone 288 and identify data corresponding to the detected ultrasonic waves.

The display 260 (for example, the display 160) includes a panel 262, a hologram device 264 or a projector 266. The panel 262 may include a configuration identical or similar to that of the display 160 illustrated in FIG. 1. The panel 262 may be implemented to be, for example, flexible, transparent, or wearable. The panel 262 and the touch panel 252 may be implemented as one module. The hologram 264 may show a three dimensional image in the air by using an interference of light. The projector 266 may display an image by projecting light onto a screen. The screen may be located, for example, inside or outside the electronic device 201. According to an embodiment, the display 260 may further include a control circuit for controlling the panel 262, the hologram device 264, or the projector 266.

The interface 270 includes a high-definition multimedia interface (HDMI) 272, a universal serial bus (USB) 274, an optical interface 276, or a d-subminiature (D-sub) 278. The interface 270 may be included in, for example, the communication interface 170 illustrated in FIG. 1. Additionally or alternatively, the interface 270 may include, for example, a mobile high-definition link (MHL) interface, a secure digital (SD) card/multi-media card (MMC) interface, or an infrared data association (IrDA) standard interface.

For example, the audio module 280 may bi-directionally convert between a sound and an electrical signal. At least some elements of the audio module 280 may be included in, for example, the input/output interface 150 illustrated in FIG. 1. The audio module 280 may process sound information which is input or output through, for example, a speaker 282, a receiver 284, earphones 286, the microphone 288 and the like. According to an embodiment, the audio module 280 may analyze the audio signal input through the microphone 288, perform an appropriate pre-processing and encoding depending on whether the analyzed audio data is a speech signal or a music signal, and then output the encoded audio signal. In addition, the audio module 280 may decode the received audio signal, analyze the decoded audio signal to perform an appropriate post-processing depending on whether the analyzed audio signal is the speech signal or the music signal, and then output the processed audio signal through the speaker 282.

The camera module 291 is, for example, a device which may photograph a still image and a video. According to an embodiment of the present disclosure, the camera module 291 may include one or more image sensors (e.g., a front sensor or a back sensor), a lens, an image signal processor (ISP) or a flash (e.g., LED or xenon lamp).

The power management module 295 may manage, for example, power of the electronic device 201. According to an embodiment, the power management module 295 may include a power management integrated circuit (PMIC), a charger integrated circuit (IC), or a battery 296 gauge. The PMIC may use a wired and/or wireless charging method. Examples of the wireless charging method may include, for example, a magnetic resonance method, a magnetic induction method, an electromagnetic method, and the like. Additional circuits (e.g., a coil loop, a resonance circuit, a rectifier, etc.) for wireless charging may be further included. The battery gauge may measure, for example, a residual charge quantity of the battery 296, and a voltage, a current, or a temperature during the charging. The battery 296 may include, for example, a rechargeable battery and/or a solar battery.

The indicator 297 may display a particular state (for example, a booting state, a message state, a charging state, and the like) of the electronic device 201 or a part (for example, the processor 210) of the electronic device 201.

The motor 298 may convert an electrical signal into mechanical vibrations, and may generate a vibration or haptic effect. The electronic device 201 may include a processor (for example, a GPU) for supporting a mobile television (TV). The processor for supporting mobile TV may, for example, process media data according to a certain standard such as digital multimedia broadcasting (DMB), digital video broadcasting (DVB), or mediaFlo™.

Each of the above-described component elements of hardware according to the present disclosure may be configured with one or more components, and the names of the corresponding component elements may vary based on the type of electronic device. In various embodiments, the electronic device may include at least one of the above-described elements. Some of the above-described elements may be omitted from the electronic device, or the electronic device may further include additional elements. Also, some of the hardware components may be combined into one entity, which may perform functions identical to those of the relevant components before the combination.

Figure 3:
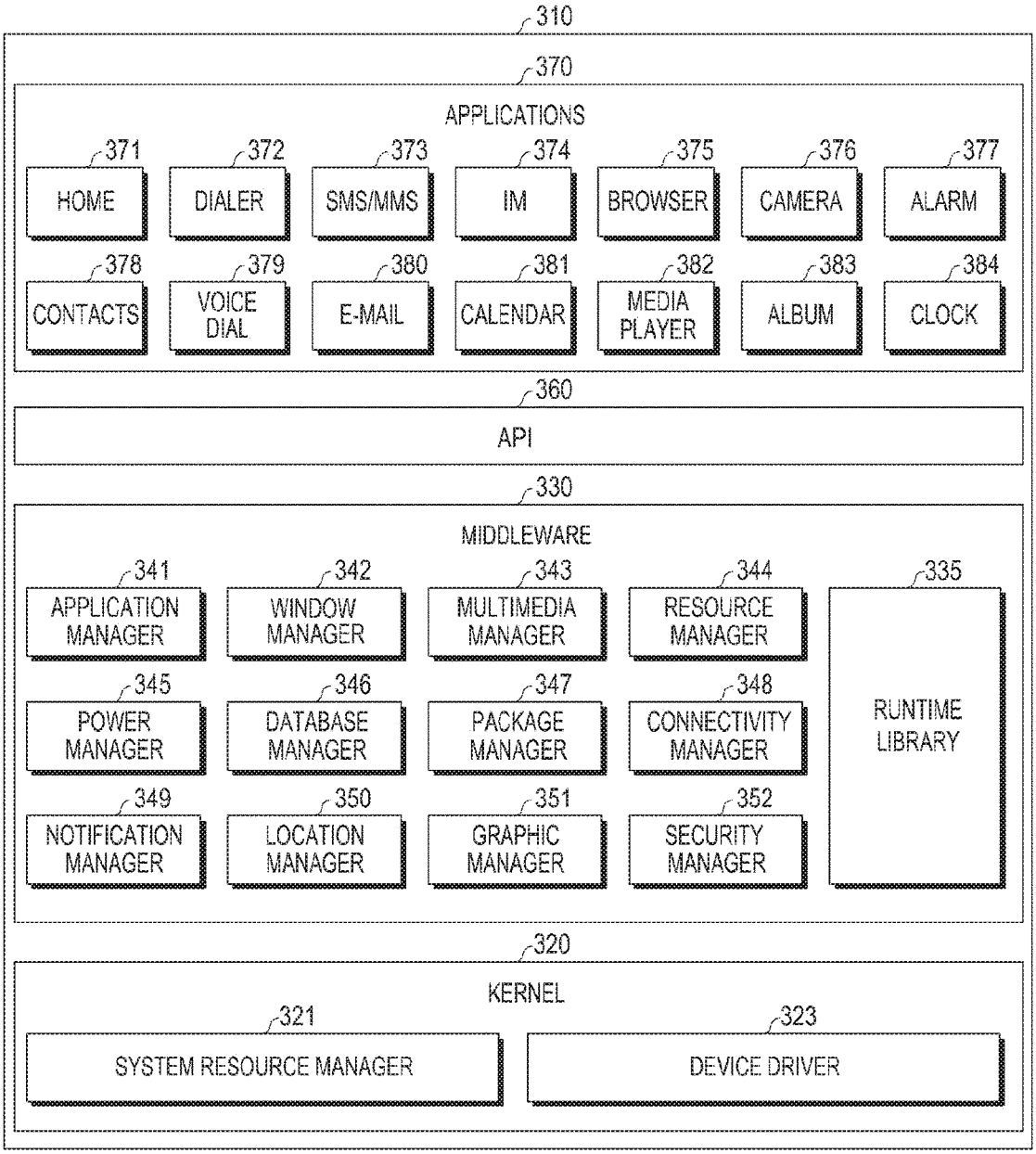
FIG. 3 is a block diagram of a programming module according to various embodiments of the present disclosure.

FIG. 3 is a block diagram of a program module according to various embodiments. According to an embodiment, the program module 310 includes an operating system (OS) for controlling resources related to an electronic device (for example, the electronic device 101) and/or various applications (for example, the application program 147) executed in the operating system. The operating system may be, for example, Android, iOS, Windows, Symbian, Tizen, Bada, and the like.

The program module 310 includes a kernel 320, middleware 330, an application programming interface (API) 360, and/or applications 370. At least some of the program module 310 may be preloaded on the electronic device, or may be downloaded from an external electronic device (for example, the electronic devices 102 and 104, or the server 106).

The kernel 320 (for example, the kernel 141) includes a system resource manager 321 and/or a device driver 323. The system resource manager 321 may perform the control, allocation, retrieval, and the like of system resources. According to an embodiment, the system resource manager 321 may include a process management unit, a memory management unit, or a file system management unit. The device driver 323 may include, for example, a display driver, a camera driver, a Bluetooth driver, a shared memory driver, a USB driver, a keypad driver, a Wi-Fi driver, an audio driver, or an inter-process communication (IPC) driver.

The middleware 330 may provide, for example, a function commonly required by the applications 370, or may provide various functions to the applications 370 through the API 360 so that the applications 370 may efficiently use limited system resources within the electronic device. According to an embodiment, the middleware 330 (for example, the middleware 143) includes at least one of a runtime library 335, an application manager 341, a window manager 342, a multimedia manager 343, a resource manager 344, a power manager 345, a database manager 346, a package manager 347, a connectivity manager 348, a notification manager 349, a location manager 350, a graphic manager 351, and a security manager 352.

The runtime library 335 may include a library module which a compiler uses in order to add a new function through a programming language while the applications 370 are being executed. The runtime library 335 may perform input/output management, memory management, the functionality for an arithmetic function, and the like.

The application manager 341 may, for example, manage a life cycle of at least one of the applications 370. The window manager 342 may manage graphical user interface (GUI) resources used for the screen. The multimedia manager 343 may determine a format required to reproduce various media files, and may encode or decode a media file by using a coder/decoder (codec) appropriate for the corresponding format. The resource manager 344 may manage resources, such as a source code, a memory, a storage space, and the like of at least one of the applications 370.

The power manager 345 may operate together with a basic input/output system (BIOS) to manage a battery or power, and may provide power information required for the operation of the electronic device. The database manager 346 may generate, search for, and/or change a database to be used by at least one of the applications 370. The package manager 347 may manage the installation or update of an application distributed in the form of a package file.

The connectivity manager 348 may manage a wireless connection such as, for example, Wi-Fi or Bluetooth. The notification manager 349 may display or notify of an event, such as an arrival message, an appointment, a proximity notification, and the like, in such a manner as not to disturb the user. The location manager 350 may manage location information of the electronic device. The graphic manager 351 may manage a graphic effect, which is to be provided to the user, or a user interface related to the graphic effect. The security manager 352 may provide various security functions required for system security, user authentication, and the like. According to an embodiment, when the electronic device 101 has a telephone call function, the middleware 330 may further include a telephony manager that manages a speech or video call function of the electronic device.

The middleware 330 may include a middleware module that forms a combination of various functions of the above-described elements. The middleware 330 may provide modules specialized according to the type of operating system in order to provide differentiated functions. Also, the middleware 330 may dynamically delete some of the existing elements, or may add new elements.

The API 360 (for example, the API 145), which is a set of API programming functions, may be provided in a different configuration for each operating system. For example, with respect to each platform, one API set may be provided in a case of Android or iOS, and two or more API sets may be provided in a case of Tizen.

The applications 370 (for example, the application programs 147) include one or more applications which may provide functions such as home 371, dialer 372, SMS/MMS 373, instant message (IM) 374, browser 375, camera 376, alarm 377, contacts 378, speech dialer 379, email 380, calendar 381, media player 382, album 383, clock 384, health care (for example, measure exercise quantity or blood sugar level), or environment information (for example, atmospheric pressure, humidity, or temperature information).

According to an embodiment, the applications 370 may include an information exchange application supporting information exchange between the electronic device 101 and an external electronic device 102 and 104. The information exchange application may include, for example, a notification relay application for transferring specific information to an external electronic device or a device management application for managing an external electronic device.

For example, the notification relay application may include a function of transferring, to the external electronic device 102 and 104, notification information generated from other applications of the electronic device 101 (for example, an SMS/MMS application, an e-mail application, a health management application, or an environmental information application). Further, the notification relay application may, for example, receive notification information from the external electronic device and provide the received notification information to a user.

The device management application may manage (for example, install, delete, or update), for example, a function for at least a part of the external electronic device 102 and 104 communicating with the electronic device (for example, turning on/off the external electronic device itself (or some elements thereof) or adjusting brightness (or resolution) of a display), applications executed in the external electronic device, or services provided from the external electronic device (for example, a telephone call service or a message service).

According to an embodiment, the applications 370 may include applications (e.g., a health care application of a mobile medical appliance, etc.) designated according to the attributes of an external electronic device (e.g., the electronic devices 102 and 104). The applications 370 may include applications received from an external electronic device 102, 104 or the server 106. The applications 370 may include a preloaded application or a third party application that may be downloaded from a server. The names of the components of the program module 310 according to the illustrated embodiment may vary according to the type of operating system.

According to various embodiments, at least a part of the programming module 310 may be implemented in software, firmware, hardware, or a combination of two or more thereof. At least some of the program module 310 may be implemented (e.g., executed) by, for example, the processor (e.g., the processor 210). At least some of the program module 310 may include, for example, a module, a program, a routine, a set of instructions, and/or a process for performing one or more functions.

The term "module" as used herein may, for example, mean a unit including one of hardware, software, and firmware or a combination of two or more of them. The term "module" may be interchangeably used with, for example, the terms "unit", "logic", "logical block", "component", or "circuit". The "module" may be a minimum unit of an integrated component element or a part thereof. The "module" may be a minimum unit for performing one or more functions or a part thereof. The "module" may be mechanically or electronically implemented. For example, the "module" according to the present disclosure may include at least one of an application-specific integrated circuit (ASIC) chip, a field-programmable gate Arrays (FPGA), and a programmable-logic device for performing operations which has been known or are to be developed hereinafter.

According to various embodiments, at least some of the devices (for example, modules or functions thereof) or the method (for example, operations) according to the present disclosure may be implemented by a command stored in a non-transitory computer-readable storage medium in a programming module form. The instruction, when executed by a processor (e.g., the processor 120), may cause the one or more processors to execute the function corresponding to the instruction. The non-transitory computer-readable storage medium may be, for example, the memory 130.

The computer readable recoding medium may include a hard disk, a floppy disk, magnetic media (e.g., a magnetic tape), optical media (e.g., a compact disc read only memory (CD-ROM) and a digital versatile disc (DVD)), magneto-optical media (e.g., a floptical disk), a hardware device (e.g., a read only memory (ROM), a random access memory (RAM), a flash memory), and the like. In addition, the program instructions may include high level language codes, which may be executed in a computer by using an interpreter, as well as machine codes made by a compiler. The aforementioned hardware device may be configured to operate as one or more software modules in order to perform the operation of the present disclosure, and vice versa.

The programming module according to the present disclosure may include one or more of the aforementioned components or may further include other additional components, or some of the aforementioned components may be omitted. Operations executed by a module, a programming module, or other component elements according to various embodiments of the present disclosure may be executed sequentially, in parallel, repeatedly, or in a heuristic manner. Further, some operations may be executed according to another order or may be omitted, or other operations may be added. Various embodiments disclosed herein are provided merely to describe technical details of the present disclosure and to help the understanding of the present disclosure, and do not limit the scope of the present disclosure. Therefore, it should be construed that all modifications and changes or modified and changed forms based on the technical idea of the present disclosure fall within the scope of the present disclosure.

Figure 4:
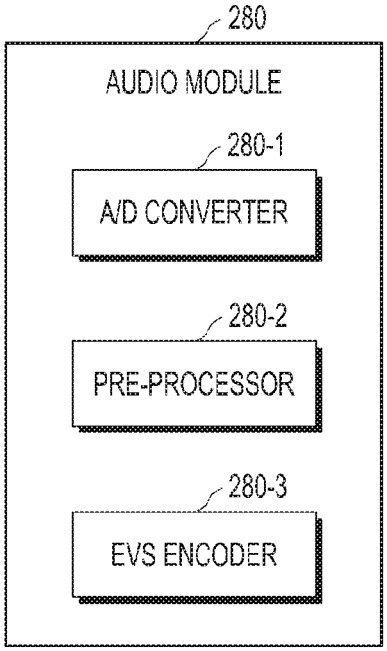
FIG. 4 is a diagram illustrating a configuration of an audio module for processing an audio signal in a transmission device in accordance with various embodiments of the present disclosure.

FIG. 4 shows a configuration diagram of an audio module for processing an audio signal in a transmission device according to various embodiments.

Referring to FIG. 4, when the electronic device 101 is a transmission device for outputting audio data, an audio module 280 includes an A/D converter 280-1, a pre-processor 280-2, and an enhanced voice services (EVS) encoder 280-3.

The A/D converter 280-1 may generate and output, for example, audio data corresponding to an audio signal input through the microphone 288.

The pre-processor 280-2 may transfer, for example, audio data output from the A/D converter 280-1 to the EVS encoder 280-3, determine the attributes of the audio data, and perform a pre-processing according to the result of the determination. According to an embodiment, the pre-processor 280-2 may determine whether the audio data is audio data associated with speech or audio data associated with music, and may change the speech quality of audio data by using a signal processing method of either a signal processing method corresponding to the speech or a signal processing method corresponding to the music, according to the result of the determination.

According to an embodiment, when the audio data is associated with speech, the pre-processor 280-2 may change the speech quality for the audio data by using a pre-processing scheme associated with speech, and when the audio data is associated with music, it may change the speech quality for the audio data by using a pre-processing scheme associated with music, based on recognition information data according to the result of the determination as to whether the audio data transmitted from the EVS encoder 280-3 corresponds to speech or music.

For example, a pre-processing scheme related to a speech signal may include methods such as strengthening of a noise suppressor (NS) for removing surrounding noise, a filter for improving articulation, an expander for removing residual noise, automatic gain control (AGC) to which anti-clipping compression is applied, and the like, and a pre-processing scheme related to the music signal may include methods such as NS function mitigation, a full-band filter for securing uniform speech range over full bands, and AGC for securing dynamic range, and the like.

The EVS encoder 280-3 may determine, for example, whether the audio data received from the pre-processor 280-2 corresponds to speech or music, generate recognition information data according to the result of the determination, and transfer the generated recognition information data to the pre-processor 280-2. For example, the recognition information data may be data indicating the attributes of the audio data. The recognition information data may include a flag value indicating whether the audio data is audio data corresponding to speech or audio data corresponding to music. Here, when the audio data includes both speech and music, the EVS encoder 280-3 may determine that the audio data corresponds to music. For example, the EVS encoder 280-3 may distinguish the speech from the audio data based on a Gaussian mixture model (GMM) and perform an operation of determining background noise so as to determine the music, speech, or background noise. Since the operation is a general operation for the EVS codec, the detailed description thereof will be omitted.

When the audio data is received from the pre-processor 280-2, the EVS encoder 280-3 may encode, for example, the pre-processed audio data and output the encoded audio data.

According to an embodiment, when the audio data is audio data corresponding to speech, the EVS encoder 280-3 may determine a first coding scheme for encoding audio data corresponding to the speech so as to perform encoding of the pre-processed audio data, and when the audio data is audio data corresponding to music, the EVS encoder 280-3 may determine a second coding scheme for encoding audio data corresponding to the music so as to perform encoding of the pre-processed audio data.

For example, the first coding scheme may include a code excited linear prediction (CELP) coding scheme, and the second coding scheme may include a modified discrete cosine transform (MDCT) coding scheme.

According to various embodiments, the EVS encoder 280-3 may transfer, to a RF module 288, an audio signal which has been encoded using a coding scheme corresponding to either the first coding scheme or the second coding scheme, and the RF module 288 may transmit the encoded audio data to a reception device.

According to various embodiments, the EVS encoder 280-3 may transfer, to a RF module 288, the audio data encoded using a coding scheme corresponding to either the first coding scheme or the second coding scheme, and transfer recognition information data together with or distinctly from the encoded audio data to the RF module 288 so that the RF module 288 may transmit, to the reception device, the encoded audio data together with, or distinctly from, the recognition information data. For example, the EVS encoder 280-3 may associate the recognition information data with the audio data and transfer, to the RF module 288, the recognition information data associated with the audio data together with, or distinctly from, the audio data.

Figure 5:
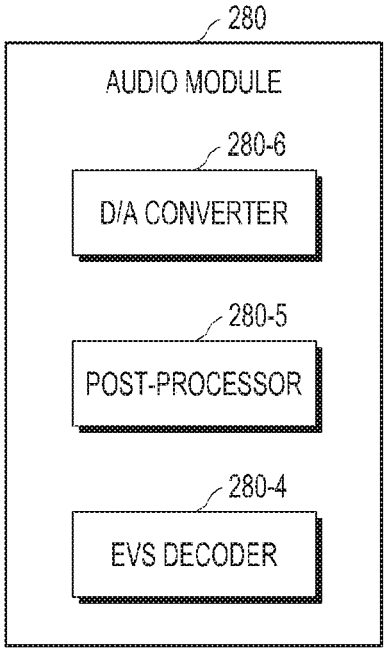
FIG. 5 is a diagram illustrating a configuration of an audio module for processing an audio signal in a reception device according to various embodiments of the present disclosure.

FIG. 5 shows a configuration diagram of an audio module for processing an audio signal in a reception device according to various embodiments.

Referring to FIG. 5 when an electronic device is a reception device that receives audio data, the audio module 280 may include an enhanced voice service (EVS) decoder 280-4, a post-processor 280-5, and a D/A converter 280-6.

The EVS encoder 280-4 may determine, for example, whether the audio data is audio data corresponding to speech or audio data corresponding to music based on at least some of the attributes of the encoded audio data received through the communication module 220, and decode the encoded audio data according to the result of the determination and output the decoded audio data.

According to an embodiment, when receiving recognition information data associated with the received encoded audio data, the EVS decoder 280-4 may determine whether the encoded audio data is audio data corresponding to speech or audio data corresponding to music based on the received recognition information data.

According to an embodiment, when recognition information data associated with the received encoded audio data has not received, the EVS decoder 280-4 may determine whether the received audio data is audio data corresponding to speech or audio data corresponding to music by analyzing the received audio data, and decode the encoded audio data according to the result of the determination and output the decoded audio data. The EVS encoder 280-4 may determine, for example, when the audio data is audio data corresponding to speech according to the result of the determination, a first decoding scheme for decoding audio data corresponding to the speech and perform decoding for the encoded audio data, and when the audio data is audio data corresponding to the music, the EVS encoder 280-4 may determine a second decoding scheme for decoding audio data corresponding to the music perform decoding for the encoded audio data.

For example, the first decoding scheme may include a code excited linear prediction (CELP) decoding scheme, and the second decoding scheme may include a modified discrete cosine transform (MDCT) decoding scheme.

When outputting the decoded audio data, the EVS decoder 280-4 may transfer, for example, the recognition information data together with the decoded audio data to the post-processor 280-5.

According to an embodiment, when outputting decoded audio data, the EVS decoder 280-4 may generate, for example, recognition information data indicating that the audio data is audio data corresponding to speech or music, and transfer the generated recognition information data together with the decoded audio data to the post-processor 280-5.

When the decoded audio data transferred from the EVS decoder 280-4 is audio data corresponding to the speech, the post-processor 280-5 may perform a post-processing by using the post-processing scheme related to the speech, and when the decoded audio data is the audio data corresponding to music, perform the post-processing by using a post-processing scheme related to the music and output the post-processed audio data.

According to an embodiment, the post-processor 280-5 may determine whether decoded audio data is audio data corresponding to speech or audio data corresponding to music based on the transferred identification information together with the decoded audio data transferred from the EVS 280-4, when the decoded audio data is audio data corresponding to the speech according to the result of the determination, convert the speech quality of the decoded audio data by using a post-processing scheme related to the speech, and when the decoded audio data is audio data corresponding to music, convert the speech quality of the decoded audio data by using a post-processing scheme related to the music, and output the converted speech quality of the decoded audio data. For example, a post-processing scheme related to the speech may include methods such as strengthening of a noise suppressor (NS) for removing surrounding noise, a filter for improving articulation, an expander for removing residual noise, an automatic gain control (AGC) to which anti-clipping compression is applied, and the like, and a pre-processing scheme related to the music may include methods such as NS function mitigation, a full-band filter for securing uniform speech range over full bands, and AGC for securing dynamic range, and the like.

The D/A converter 280-6 may output, for example, an audio signal corresponding to the post-processed audio data to the speaker 282.

According to an embodiment, the D/A converter 280-6 may generate an audio signal corresponding to the converted audio data by using a signal processing method corresponding to either a signal processing method corresponding to speech or a signal processing method corresponding to music, and output the generated audio signal to the speaker 282.

The audio module 280 according to an embodiment of the present disclosure may perform a pre-processing and encoding or perform decoding and post-processing for the audio data under the control of the processor 210, or according to various embodiments, the processor 210 may perform the operation of the audio module 280 described above or the A/D converter, D/A converter, pre-processor, EVS encoder, post-processor, and EVS decoder may be included in the processor 210.

According to various embodiments, the present disclosure has been described to process audio data by using the EVS encoder and EVS decoder, but it is not limited thereto, and the present disclosure may determine whether the audio data corresponds to speech or music and use various encoders or decoders to perform encoding by using a coding scheme corresponding to speech or music or decoding by using a decoding scheme corresponding to speech or music.

Figure 6:
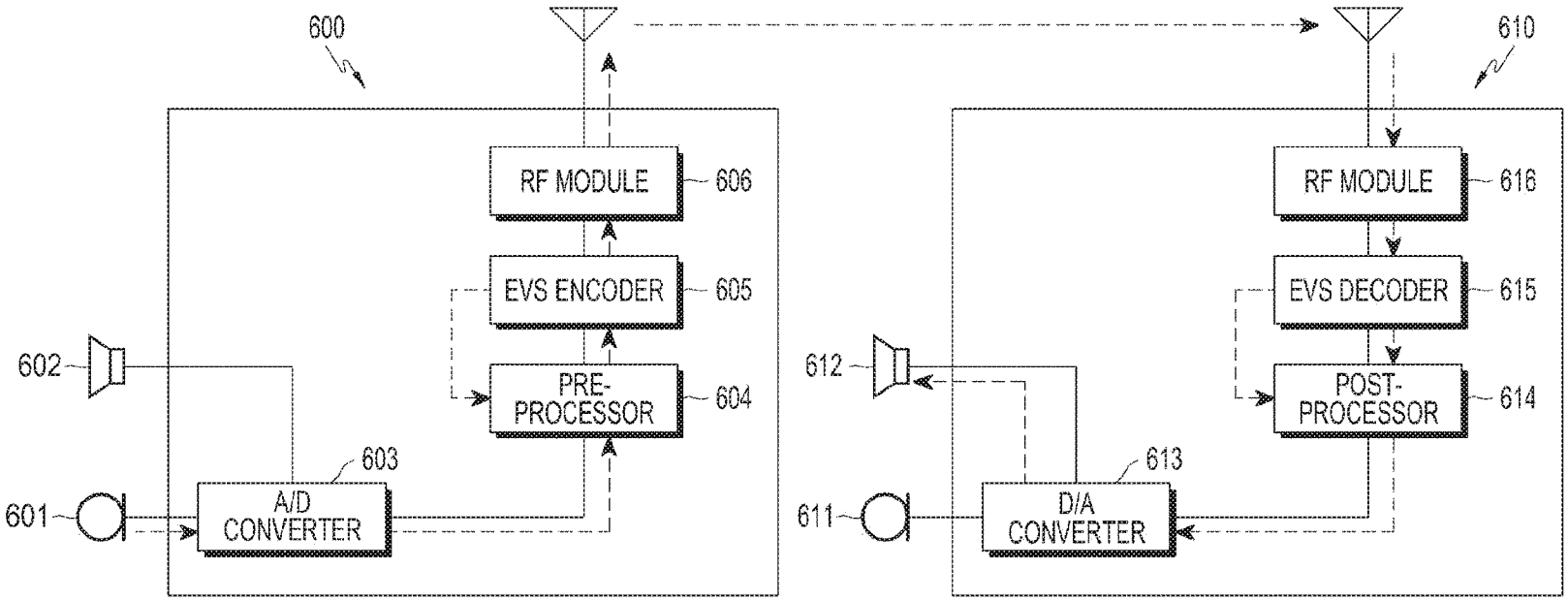
FIG. 6 is a diagram illustrating a configuration of a transmission device for transmitting an audio signal and a reception device for receiving an audio signal according to various embodiments of the present disclosure.

FIG. 6 is a diagram illustrating a configuration of a transmission device for transmitting an audio signal and a reception device for receiving an audio signal according to various embodiments.

Referring to FIG. 6, the transmission device 600 includes a microphone 601 for converting an external sound input to an audio signal and outputting the converted audio signal, a speaker 602 for converting the audio signal to sound and outputting the sound, an A/D converter 603 for generating and outputting audio data corresponding to the audio signal, a pre-processor 604 for pre-processing the audio data, an EVS encoder 605 for encoding the pre-processed audio data, and an RF module 606 for transferring the encoded audio data to the reception device 610.

According to an embodiment, the pre-processor 604 of the transmission device 600 may transfer the audio data to the EVS encoder 605 prior to pre-processing the audio data, determine whether the audio data is audio data corresponding to speech or audio data corresponding to music based on the recognition information data transferred through the EVS encoder 605, and perform the pre-processing on the audio data according to the result of the determination. For example, when it is determined that the audio data is audio data corresponding to speech on the basis of the recognition information data, the pre-processor 604 may change the speech quality of the audio data by using a pre-processing scheme corresponding to speech and generate the changed audio data. When it is determined that the audio data is audio data corresponding to music, the pre-processor 604 may change the speech quality of the audio data by using a pre-processing scheme corresponding to music and generate the changed audio data.

According to an embodiment, the EVS encoder 605 may determine whether the audio data is audio data corresponding to speech or audio data corresponding to music by analyzing the audio data transferred through the pre-processor 604, generate recognition information data indicating whether the audio data corresponds to speech or music according to the result of the determination, and transfer the generated recognition information to the pre-processor 604.

When receiving the pre-processed audio data from the pre-processor 604, the EVS encoder 605 may encode the changed audio data by using a first coding scheme corresponding to speech when, for example, the audio data is audio data corresponding to speech. For example, the first coding scheme may include a CELP coding scheme.

When the audio data is audio data corresponding to music, the EVS encoder 605 may encode, for example, the changed audio data by using a second coding scheme corresponding to music. For example, the second coding scheme may include a MDCT coding scheme.

The EVS encoder 605 may transfer, for example, the encoded audio data to the RF module 606. According to an embodiment, the EVS encoder 605 may transfer, to the RF module 606, the recognition information data together with, or distinctly from, the encoded audio data.

The RF module 606 may transmit, for example, the encoded audio data to the reception device 610. According to an embodiment, the RF module 606 may transmit, to the reception device 610, the recognition information data together with the encoded audio data or distinctly therefrom.

The reception device 610 includes an RF module 616 for receiving the encoded audio data from the transmission device 600, an EVS decoder 615 for decoding the encoded audio data, a post-processor 614 for post-processing the decoded audio data, a D/A converter 613 for generating and outputting audio data corresponding to the post-processed audio data, a speaker 612 for converting the audio signal to sound and outputting the sound, and a microphone 611 for converting an external sound to an electronic signal and outputting the electronic signal.

According to an embodiment, when receiving the recognition information data, the EVS decoder 615 of the reception device 610 may determine whether the encoded audio data is audio data corresponding to speech or audio data corresponding to music based on the received recognition information data, and decode the encoded audio data by using a first decoding scheme corresponding to speech or decode the encoded audio data by using a second decoding scheme corresponding to music, according to the result of the determination. For example, the first decoding scheme may include a CELP decoding scheme, and the second decoding system may include a MDCT decoding scheme.

The EVS decoder 615 may transfer, for example, the recognition information data together with the decoded audio data to the post-processor 614.

According to an embodiment, when the recognition information data has not been received, the EVS decoder 615 may determine whether the audio data is audio data corresponding to speech or audio data corresponding to music based on at least some attributes of the encoded audio data, and decode the encoded audio data by using a first decoding scheme corresponding to speech or decode the encoded audio data by using a second decoding scheme corresponding to music, according to the result of the determination. Here, the EVS decoder 615 may generate the recognition information data indicating whether the decoded audio data is audio data corresponding to speech or audio data corresponding to music, and transfer the generated recognition information data together with the decoded audio data to the post-processor 614.

The post-processor 614 may determine whether the decoded audio data is audio data corresponding to speech or audio data corresponding to music based on the recognition information data, and post-process the decoded audio data by using a post-processing scheme corresponding to speech or a post-processing scheme corresponding to music, according to the result of the determination, and output the post-processed audio data.

Figure 7:
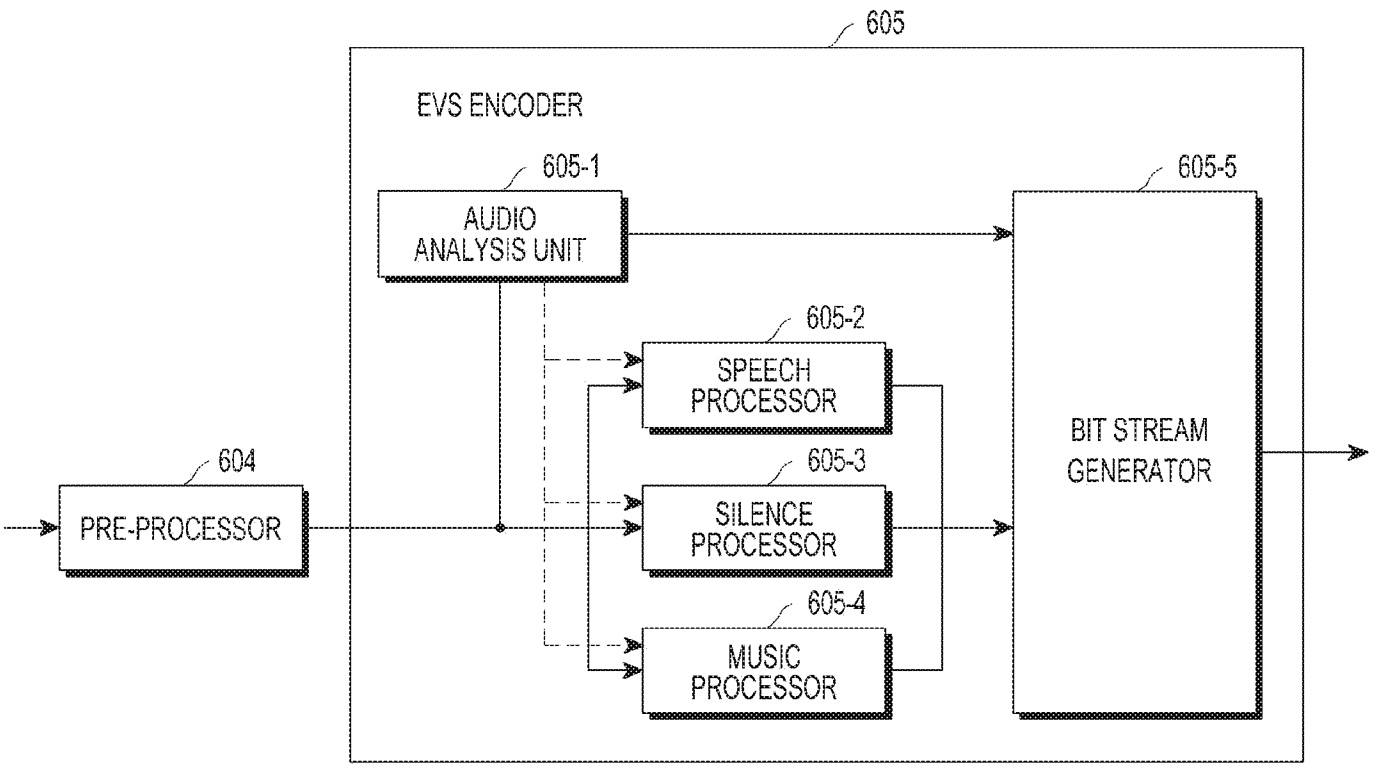
FIG. 7 is a diagram illustrating a configuration of an EVS encoder included in a transmission device according to various embodiments of the present disclosure.

FIG. 7 is a diagram illustrating a configuration of an EVS encoder included in a transmission device according to various embodiments.

Referring to FIG. 7, the EVS encoder 605 includes an audio analysis unit 605-1, a speech processor 605-2, a silence processor 605-3, a music processor 605-4, and a bit stream generator 605-5.

The audio analysis unit 605-1 may analyze, for example, audio data transferred through the pre-processor 604, and determine whether the audio data is audio data corresponding to any one of speech, silence, and music. According to the result of the determination, the audio analysis unit 605-1 may transfer the audio data to the speech processor 605-2 when the audio data corresponds to speech, transfer the audio data to the silence processor 605-3 when the audio data corresponds to silence, and transfer the audio data to the music processor 605-4 when the audio data corresponds to music.

According to an embodiment, the audio analysis unit 605-1 may generate recognition information data indicating the determination result and transfer the recognition information data to the pre-processor 604.

The speech processor 605-2 may perform coding on the audio data, for example, by using a first coding scheme such as the CELP coding scheme corresponding to speech.

The silence processor 605-3 may perform coding on the audio data so as to generate, for example, noise in the audio data. For example, the silence processor 605-3 may perform coding on the audio data so as to generate noise by using a comfort noise generation (CNG) scheme.

The music processor 605-4 may perform coding on the audio data, for example, by using a second coding scheme such as the MDCT coding scheme corresponding to music.

The audio analysis unit 605-1 may generate, for example, recognition information data including the determination result, and combine or multiplex (MUX) the generated recognition information data with the encoded audio data so as to transfer the combined data to the bit stream generator 605-5.

The bit stream generator 605-5 may output, for example, the combined data as a bit stream.

Figure 8:
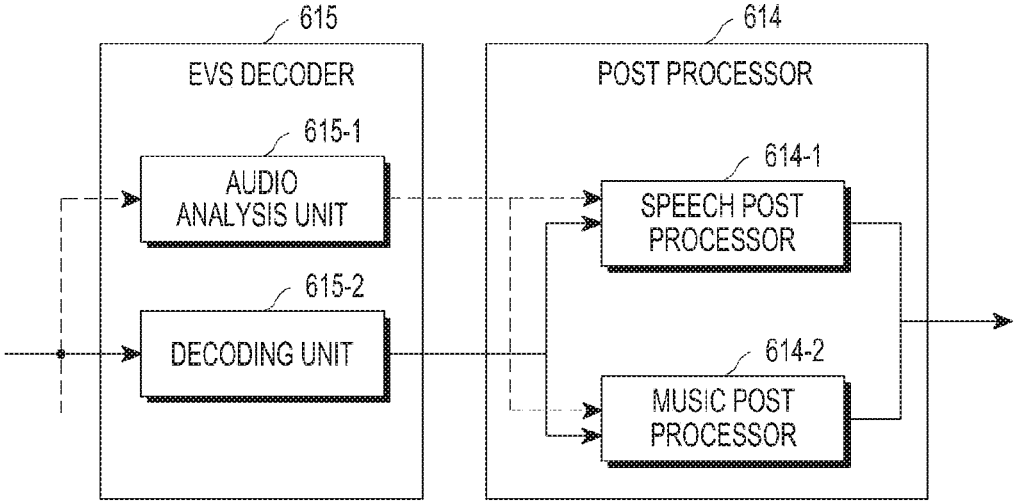
FIG. 8 is a diagram illustrating a configuration of an EVS decoder and post-processor included in a reception device according to various embodiments of the present disclosure.

FIG. 8 is a diagram illustrating a configuration of an EVS decoder and a post-processor included in a reception device according to various embodiments.

According to FIG. 8, the EVS decoder 615 may include an audio analysis unit 615-1 and a decoding unit 615-2, and a post-processor 614 may include a speech post-processor 614-1 and a music post-processor 614-2.

The audio analysis unit 615-1 of the EVS decoder 615 may determine whether the audio data is audio data corresponding to speech or audio data corresponding to music by analyzing the received audio data.

According to an embodiment, upon receiving the recognition information data from the transmission device 600, the audio analysis unit 615-1 may determine whether the encoded audio data is audio data corresponding to speech or audio data corresponding to music based on the received recognition information data.

If not receiving the recognition information data from the transmission device 600 according to an embodiment, the audio analysis unit 615-1 may determine whether the received audio data is audio data corresponding to speech or audio data corresponding to music by analyzing the audio data, and generate recognition information data indicating a result of the determination.

The decoding unit 615-2 may decode the encoded audio data, for example, by using a decoding scheme corresponding to speech or by using a decoding scheme corresponding to music according to a result determined by the audio analysis unit 615-1.

The decoded audio data together with the recognition information data may be transferred to the post-processor 614.

The post-processor 614 may determine whether the audio data corresponds to speech or music based on the recognition information data transmitted from the EVS decoder 615, and perform post-processing on the audio data by using a post-processing scheme corresponding to speech or music, according to the result of the determination.

The speech post-processor 614-1 may perform, for example, a post-processing on the decoded audio data by using the post-processing scheme corresponding to the speech. For example, the post-processing scheme corresponding to the speech may include a far-end noise suppression (FENS) scheme for reducing or removing noise from the audio signal on the reception side, a cut off scheme for removing a low-band portion of the frequency domain of an audio signal, an AGC scheme for constantly adjusting the dynamics of the audio signal, etc.

The music post-processor 614-2 may perform, for example, a post-processing on the decoded audio data by using the post-processing scheme corresponding to the music. For example, the post-processing scheme corresponding to the music may include a FENS scheme which does not remove noise or lowers the noise when the audio signal corresponds to music, a cut off scheme for lowering cut-off when the audio signal corresponds to music, and an adjustment method for adjusting AGC attack/release time according to the music when the audio signal corresponds to music. The attack/release time refers to a duration of time required until a maximum sound level is reached after a sound starts. Adjustment of the AGC attack/release time may eliminate problems that music is vibrated or is muted from low sound.

Figure 9:
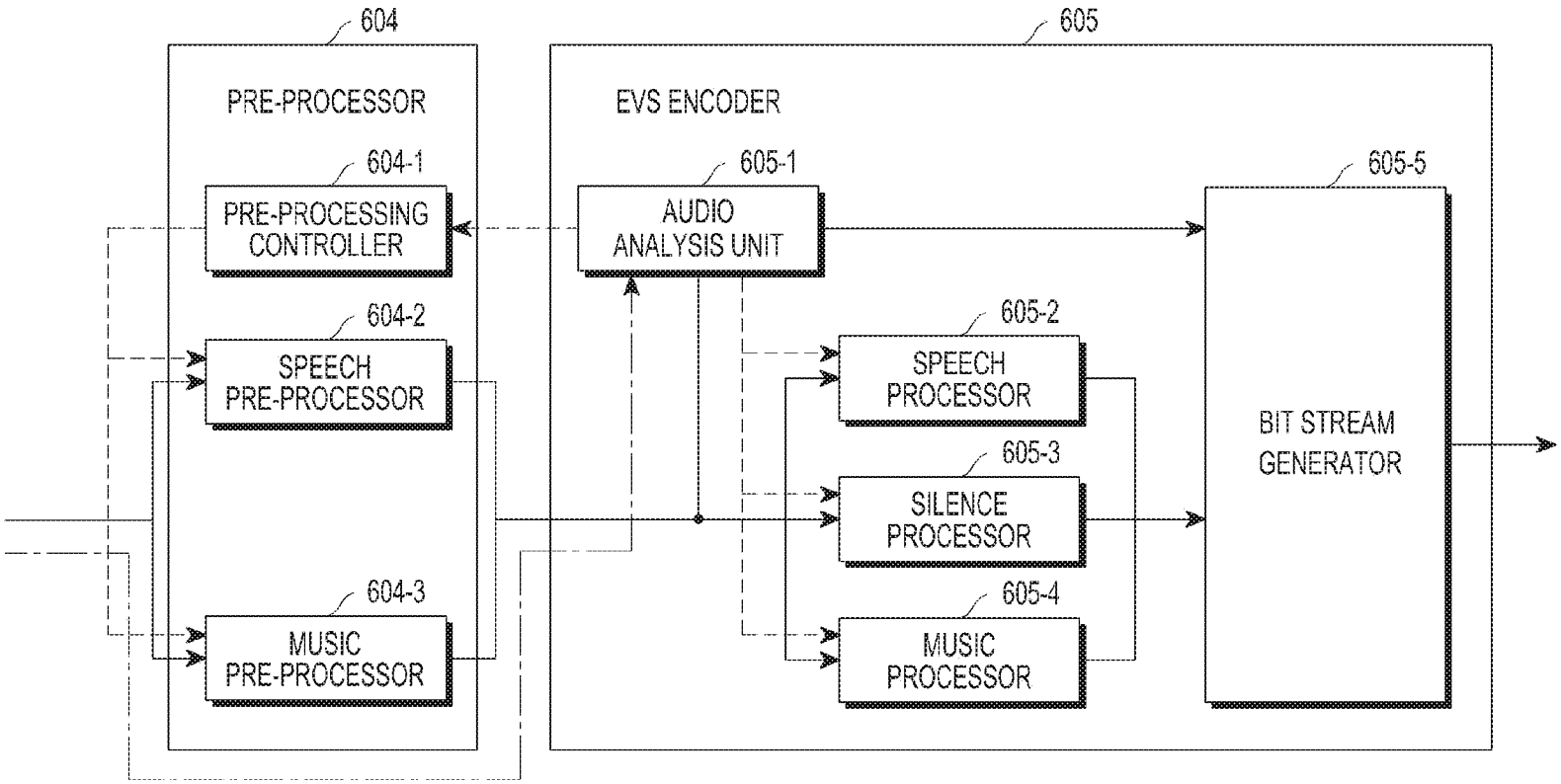
FIG. 9 is a diagram illustrating a configuration of a transmission device including a pre-processor and an EVS decoder according to various embodiments of the present disclosure.

FIG. 9 is a diagram illustrating a configuration of a transmission device including a pre-processing unit and an EVS decoder according to various embodiments.

A pre-processor 604 includes a pre-processing controller 604-1, a speech pre-processor 604-2, and a music pre-processor 604-3, and an EVS encoder 605 includes an audio analysis unit 605-1, a speech processor 605-2, a silence processor 605-3, a music processor 605-4, and a bit stream generator 605-5.

The audio analysis unit 605-1 of the EVC encoder 605 may receive, for example, audio data through the music pre-processor 604-3 of the pre-processor 604. According to various embodiments, the pre-processor 604 may transmit the audio data to the EVS encoder 605 through the music pre-processor 604-3 before performing the pre-processing for the audio data, in order to reduce the loss of the audio data.

The audio analysis unit 605-1 may analyze, for example, the audio data transmitted through the music pre-processor 604-3, and when it is determined that at least some of the analyzed audio data is speech or music, and transfer the recognition information data including a result of the determination to the pre-processing controller 604-1.

The pre-processing controller 604-1 may control the speech pre-processor 604-2 or music pre-processor 640-3 to perform pre-processing on the audio data based on the recognition information data transmitted from the audio analysis unit 605-1. For example, when it is determined that at least some of the audio data is speech according to the determination result, the pre-processing controller 604-1 may perform pre-processing on the audio data through the speech pre-processor 604-2, and when it is determined that at least some of the audio data is music, it may perform pre-processing on the audio data through the music pre-processor 604-3.

In an embodiment of the present disclosure described above, the audio analysis unit 605-1 has been configured to be included in the EVS encoder 605, but it may be configured separately from the EVS encoder 605.

Figure 10:
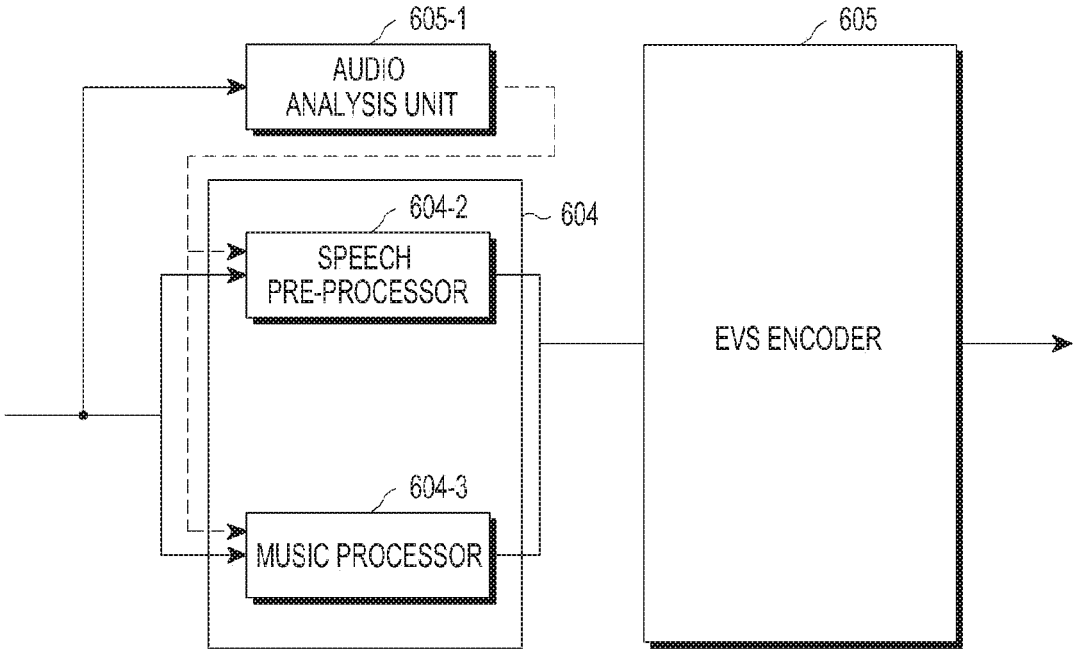
FIG. 10 is a diagram illustrating a configuration of a transmission device having an audio analysis unit and an EVS encoder separately configured therein according to various embodiments of the present disclosure.

FIG. 10 is a diagram illustrating a configuration of a transmission device having an audio analysis unit and an EVS encoder which are separately configured therein according to various embodiments.

According to FIG. 10, the audio analysis unit 605-1 is configured separately from the EVS encoder 605, and when receiving the audio data, it may determine whether the audio data is speech or music by analyzing the audio data prior to pre-processing the audio data by the pre-processor 604, and generate recognition information data including a result of the determination and transmit the recognition information data to the pre-processor 604.

When the audio data corresponds to speech, the pre-processor 604 may pre-process, through the speech pre-processor 604-2, the audio data by using a pre-processing scheme corresponding to speech based on the recognition information data, and when the audio data corresponds to music, it may pre-process, through the music pre-processor 604-3, the audio data by using the pre-processing scheme corresponding to music. For example, a pre-processing scheme corresponding to the speech may include methods such as strengthening of noise suppressor (NS) for removing surrounding noise, a filter for improving articulation, an expander for removing residual noise, an automatic gain control (AGC) to which anti-clipping compression is applied, and the like. In addition, a pre-processing scheme related to music may include methods such as mitigation or minimization of an NS function, a full-band filter for securing a uniform speech range over all bands, and AGC for securing dynamic range, and the like.

Figure 11:
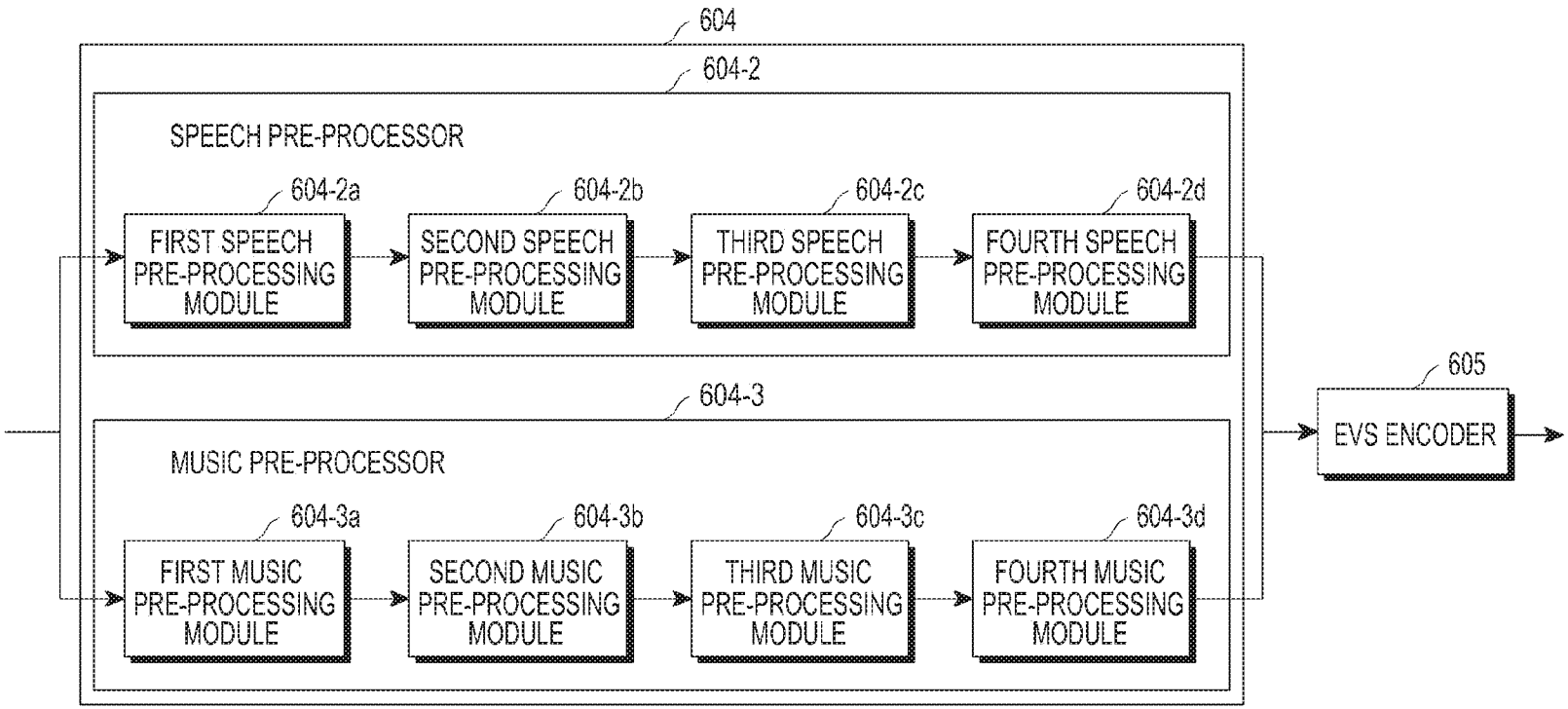
FIG. 11 is a diagram illustrating a configuration of a pre-processor according to various embodiments of the present disclosure.

FIG. 11 is a diagram illustrating a configuration of a pre-processor according to various embodiments.

According to FIG. 11, the pre-processor 604 includes a speech pre-processor 604-2 and a music pre-processor 604-3.

The speech pre-processor 604-2 may perform, for example, a pre-processing on the audio data by using the pre-processing scheme corresponding to speech. For example, the speech pre-processor 604-2 may include at least one of a first speech pre-processing module 604-2*a* for removing an echo, a second speech pre-processing module 604-2*b* for removing surrounding noise, a third speech pre-processing module 604-2*c* for performing filtering for improving clarity, and a fourth speech pre-processing module 604-2*d* for performing AGC to prevent clipping.

The music pre-processor 604-3 may perform, for example, pre-processing on the audio data by using the pre-processing scheme corresponding to music. For example, the music pre-processor 604-3 may include at least one of a first music pre-processing module 604-3*a* for removing echo, a second music pre-processing module 604-3*b* for removing a surrounding noise, a third music pre-processing module 604-3*c* for performing full-band filtering, and a fourth music pre-processing module 604-3*d* for performing AGC for securing a dynamic range.

Figure 12:
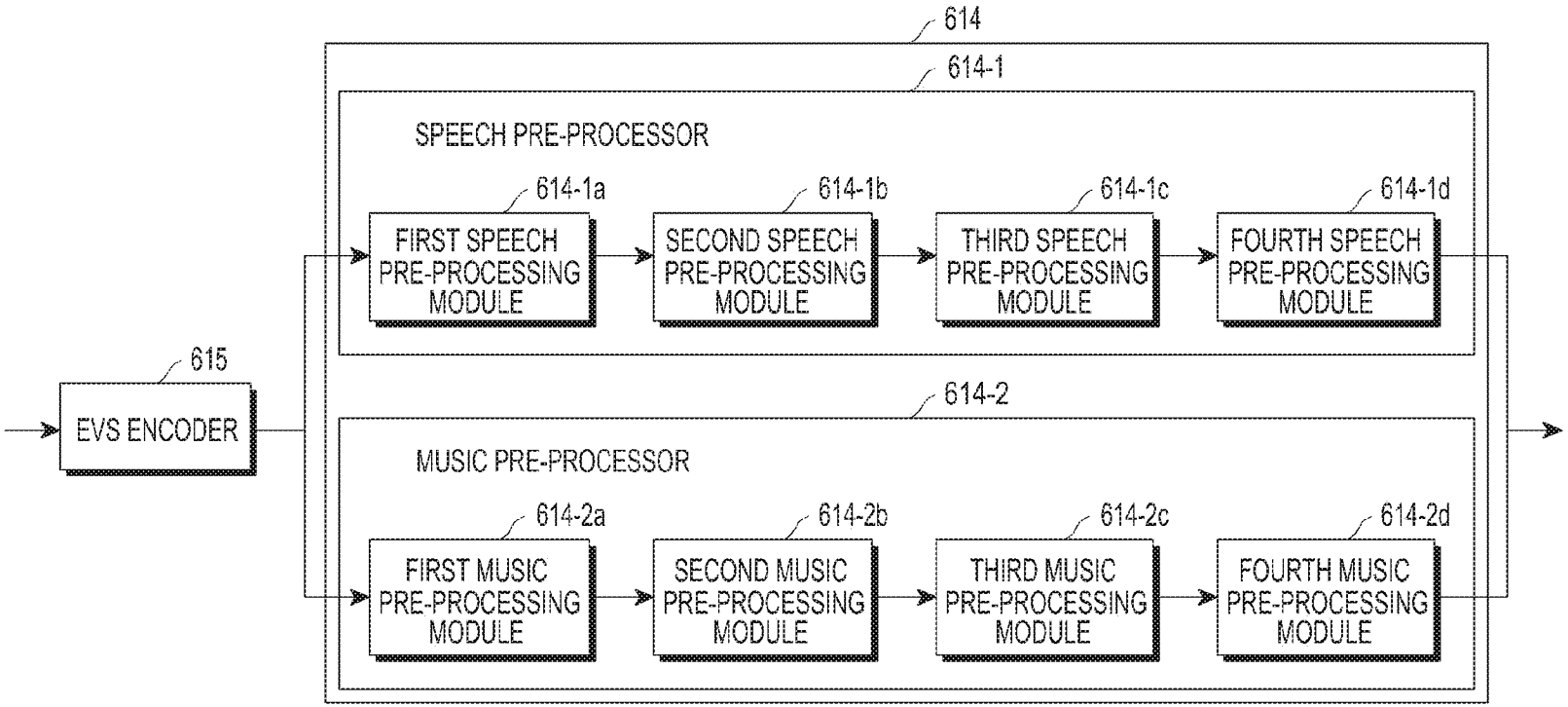
FIG. 12 is a diagram illustrating a configuration of a post-processor according to various embodiments of the present disclosure.

FIG. 12 is a diagram illustrating a configuration of a post-processor according to various embodiments.

According to FIG. 12, the post-processor 614 may include a speech post-processor 614-1 and a music post-processor 614-2.

The speech post-processor 614-1 may perform, for example, post-processing on the audio data by using the post-processing scheme corresponding to speech. For example, the speech post-processor 614-1 may include at least one of a first speech post-processing module 614-1*a* for lowering or removing noise, a second speech post-processing module 614-1*b* for removing surrounding noise, a third speech post-processing module 614-1*c* for performing filtering for improving clarity, and a fourth speech post-processing module 614-1*d* for performing AGC to prevent clipping. According to various embodiments, the speech post-processing module may include a module for performing a cut-off scheme, and a module for uniformly adjusting the dynamic range of a signal.

The music post-processor 614-2 may perform, for example, post-processing on the audio data by using the post-processing scheme corresponding to music. For example, the music post-processor 614-2 may include at least one of a first music post-processing module 614-2*a* for lowering or removing noise, a second music post-processing module 614-2*b* for removing surrounding noise, a third music post-processing module 614-2*c* for performing full-band filtering, and a fourth music post-processing module 614-2*d* for performing AGC for securing a dynamic range. According to various embodiments, the music post-processing modules may further include a module for performing a cut-off scheme, a module for performing adjustment of AGC attack/release time, etc.

According to various embodiments of the present disclosure, an electronic device may include a speaker, a communication module configured to communicate with an external electronic device, and a processor functionally connected to the communication module, wherein the processor is configured to receive data from the external electronic device by using the communication module; when the data corresponds to speech, decode the data by using a first decoding scheme and change the speech quality of the decoded data using a first signal processing scheme, when the data corresponds to music, decode the data by using a second decoding scheme and change the speech quality of the decoded data using a second signal processing scheme, and output, through the speaker, an audio signal corresponding to the data changed using a signal processing scheme corresponding to either the first signal processing scheme or the second signal processing scheme.

According to various embodiments of the present disclosure, the electronic device may include a microphone, a communication module configured to communicate with an external electronic device, and a processor functionally connected to the communication module, wherein the processor is configured to, receive an audio signal through the microphone, generate data corresponding to the audio signal, determine attributes of the audio signal based on the data, change the speech quality of the data by using a first signal processing method when the audio signal corresponds to speech, and encode the changed data by using a first coding scheme, change the speech quality of the data by using a second signal processing method when the audio signal corresponds to music, and encode the changed data by using a second coding scheme, and transmit, to the external device, through a communication module the audio signal which has been encoded using a coding scheme corresponding to either the first coding scheme or the second coding scheme.

Figure 13:
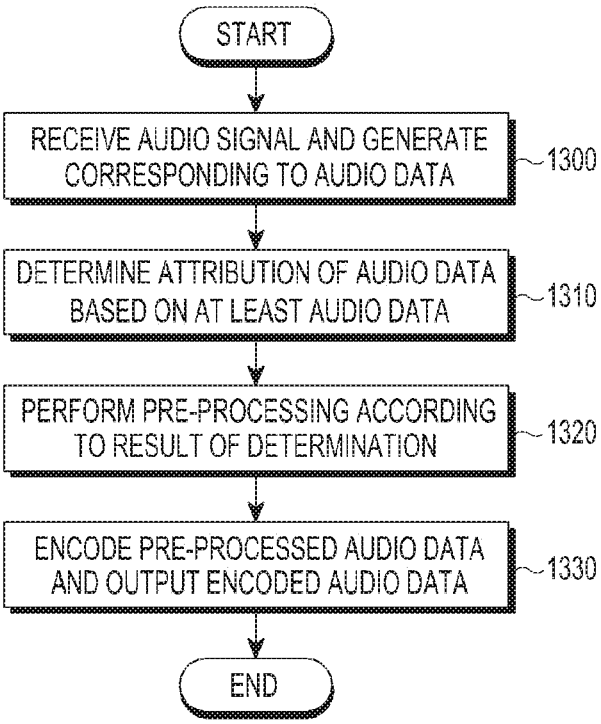
FIG. 13 is a flowchart illustrating a process of processing audio data by a transmission device according to various embodiments of the present disclosure.

FIG. 13 is a flowchart illustrating a process of processing audio data by a transmission device according to various embodiments.

According to an embodiment, when the electronic device 101 performs an operation of the transmission device 600, in step 1300 of FIG. 13, the electronic device 101 (for example, the processor 210) receives an audio signal and generates corresponding audio data, and in step 1310, determines the attributes of the audio data at least partially based on the audio data.

According to an embodiment the electronic device 101 may generate audio data corresponding to the received audio signal and transmit the audio data to the EVS encoder 280-3.

The electronic device 101 (for example, the processor 210) may determine whether the audio data is audio data corresponding to speech or audio data corresponding to music by analyzing the audio data prior to pre-processing.

In step 1320, the electronic device 101 (for example, the processor 210) performs a pre-processing on the audio data according to the result of the determination.

According to an embodiment, when it is determined that the audio data is the audio data corresponding to the speech, the electronic device 101 performs pre-processing by using the pre-processing scheme corresponding to speech, and when it is determined that the audio data is audio data corresponding to music, it may perform a pre-processing by using a pre-processing scheme corresponding to music.

In step 1330, the electronic device 101 encodes the pre-processed audio data and then outputs the encoded audio data.

According to an embodiment, when the audio data is audio data corresponding to speech, the electronic device 101 may encode the pre-processed audio data by using a coding scheme corresponding to speech, and when the audio data is audio data corresponding to music, it may encode the pre-processed audio data by using a coding scheme corresponding to music.

According to an embodiment, the electronic device 101 may generate recognition information data indicating whether the audio data is audio data corresponding to speech or music, and transmit the encoded audio data and recognition information data to the reception device 610.

Figure 14:
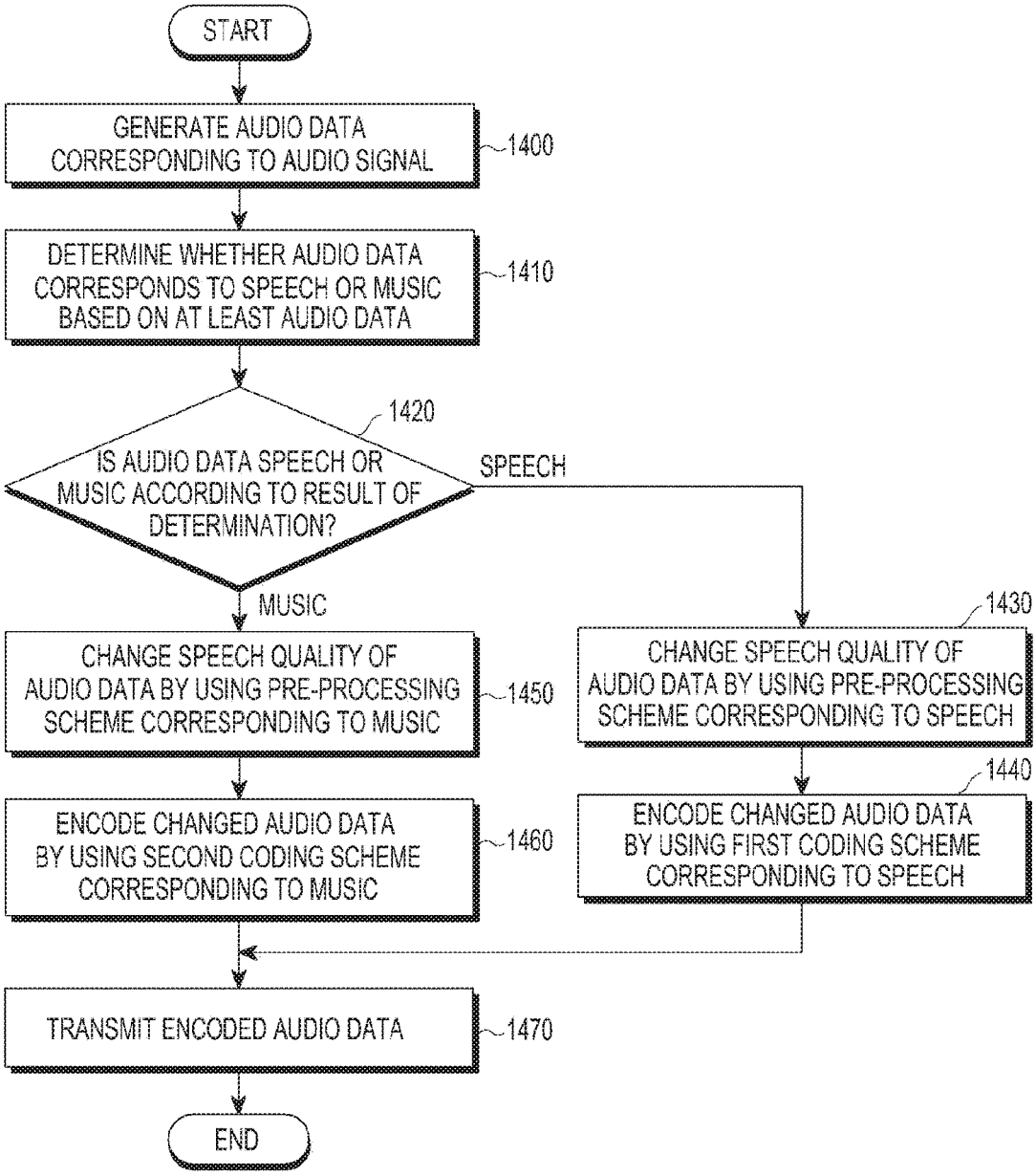
FIG. 14 is a flowchart illustrating a process of processing audio data by a transmission device according to various embodiments of the present disclosure.

FIG. 14 is a flowchart illustrating a process of processing audio data by a transmission device according to various embodiments.

According to an embodiment, when the electronic device 101 performs an operation of the transmission device 600, in step 1400 of FIG. 14, the electronic device 101 receives audio data and generates an audio signal corresponding to the received audio data, and in step 1410, determines whether the audio data corresponds to speech or music at least partially based on the audio data.

In step 1420, the electronic device 101 proceeds to step 1430 when the audio data is audio data corresponding to speech as a result of the determination, and proceeds to step 1450 when the audio data is audio data corresponding to music.

In step 1430, the electronic device 101 may change the speech quality of the audio data by using a pre-processing scheme corresponding to speech.

In step 1440, the electronic device 101 encodes the changed audio data by using a first coding scheme corresponding to speech.

In step 1450, the electronic device 101 changes the speech quality of the audio data by using a pre-processing scheme corresponding to music.

In step 1460, the electronic device 101 encodes the changed audio data by using a second coding scheme corresponding to music.

In step 1470, the electronic device 101 may transmit the encoded audio data to the reception device 610.

Figure 15:
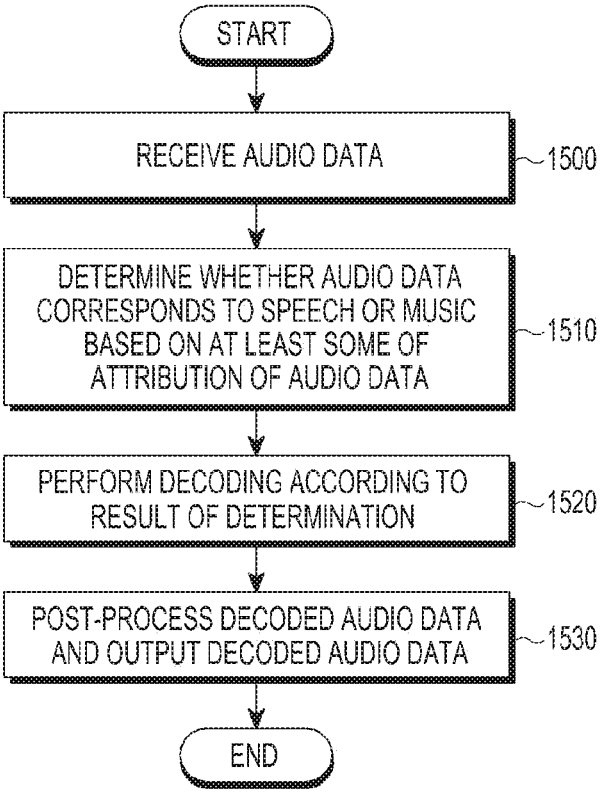
FIG. 15 is a flowchart illustrating a process of processing audio data by a reception device according to various embodiments of the present disclosure.

FIG. 15 is a flowchart illustrating a process of processing audio data by a reception device according to various embodiments.

According to an embodiment, when the electronic device 101 performs an operation of the reception device 610, the electronic device receives audio data in step 1500, and determines whether the audio data corresponds to speech or music based on at least some of the attributes of the audio data in step 1510.

According to an embodiment, when receiving recognition information data from the transmission device 600, the electronic device 101 may check the received recognition information data and determine whether the audio data corresponds to speech or music.

According to an embodiment, when the recognition information data has not been received from the transmission device 600, the electronic device 101 may analyze the audio data and determine whether the audio data corresponds to speech or music.

In step 1520, the electronic device 101 performs decoding of the audio data according to the result of the determination.

According to an embodiment, when the audio data is audio data corresponding to speech, the electronic device 101 may decode the audio data by using a first decoding scheme corresponding to speech, and when the audio data is audio data corresponding to music, it may decode the audio data by using a second decoding scheme corresponding to music.

In step 1530, the electronic device 101 post-processes the decoded audio data and then outputs the post-processed audio data.

According to an embodiment, when the audio data is audio data corresponding to speech, the electronic device 101 may post-process the audio data by using a post-processing scheme corresponding to speech, and when the audio data is audio data corresponding to music, it may post-process the audio data by using a post-processing scheme corresponding to music.

Figure 16:
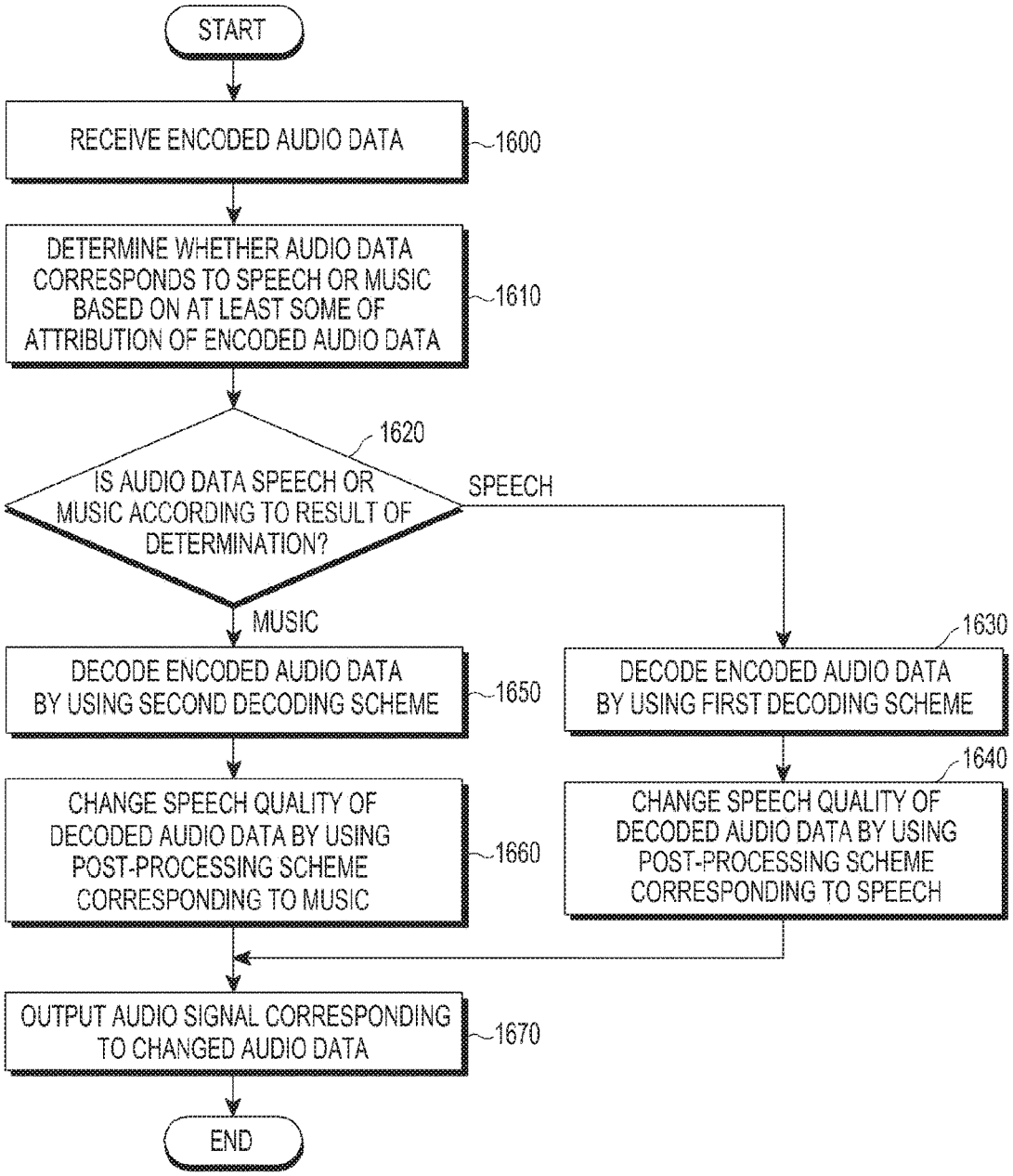
FIG. 16 is a flowchart illustrating a process of processing audio data by a reception device according to various embodiments of the present disclosure.

FIG. 16 is a flowchart illustrating a process of processing audio data by a reception device according to various embodiments.

According to an embodiment, when the electronic device 101 performs an operation of the reception device 610, the electronic device 101 receives the encoded audio data in step 1600 of FIG. 16, and determines whether the audio data corresponds to speech or music based on at least some of the attributes of the received audio data in step 1610.

In step 1620, the electronic device 101 proceeds to step 1630 when the audio data is audio data corresponding to speech as a result of the determination, and proceeds to step 1650 when the audio data is audio data corresponding to music.

In step 1630, the electronic device 101 decodes the audio data by using a first decoding scheme corresponding to speech.

In step 1640, the electronic device 101 changes the speech quality of the decoded audio data by using a post-processing scheme corresponding to speech.

In step 1650, the electronic device 101 decodes the audio data by using a second decoding scheme corresponding to music.

In step 1660, the electronic device 101 changes the speech quality of the decoded audio data by using a post-processing scheme corresponding to music.

In step 1670, the electronic device 101 outputs an audio signal corresponding to the changed audio data.

According to an embodiment, the electronic device 101 may convert the audio data into an audio signal corresponding to audio data changed using a signal processing method corresponding to speech or a signal processing method corresponding to music and then output the converted audio signal.

As described above, various embodiments of the present disclosure may analyze whether the audio signal is speech or music and perform an appropriate process depending on the speech or music to improve an articulation of the audio signal and uniformly reproduce the full band of the audio signal.

The embodiments disclosed in the present disclosure and drawings are provided to describe and facilitate a thorough understanding of the present disclosure but do not limit the scope of the present disclosure. Therefore, it should be construed that all modifications or modified forms of the technical idea of the present disclosure in addition to the embodiments disclosed herein are included in the scope of the present disclosure as defined by the appended claims and their equivalents.

What is claimed is:

1. An electronic device comprising:

a speaker;

a communication module configured to communicate with an external electronic device; and a processor connected to the communication module, wherein the processor is configured to:

receive data and additional data from the external electronic device using the communication module, the additional data indicating attributes of the data;

when the attributes of the data are determined to be speech according to the additional data, decode the data using a first decoding scheme and change the quality of the decoded data using a first signal processing scheme, which is at least one of a plurality of first signal post-processing schemes;

when the attributes of the data are determined to be music according to the additional data, decode the data using a second decoding scheme, which is different than the first decoding scheme, and change the quality of the decoded data by using a second signal processing scheme, which is at least one of a plurality of second signal post-processing schemes, wherein the second signal processing scheme is different than the first signal processing scheme; and output, through the speaker, an audio signal corresponding to the data changed using the first signal processing scheme or the second signal processing scheme, wherein the plurality of first signal post-processing schemes includes a scheme for reducing or removing noise from the decoded data, a scheme for removing a low-band portion of the frequency domain of the decoded data, and a scheme for adjusting dynamics of the decoded data.

2. The electronic device of claim 1, wherein the processor is further configured to receive the data during a call connection with the external electronic device.

3. The electronic device of claim 1, wherein the plurality of second signal post-processing schemes includes a FENS scheme which does not remove noise or lower the noise when the audio signal corresponds to music, a cut off scheme for lowering cut-off when the audio signal corresponds to music, and an adjustment method for adjusting AGC attack/release time according to the music when the audio signal corresponds to music.

4. A method comprising:

receiving data and additional data from an external electronic device, the additional data indicating attributes of the data;

decoding, when the attributes of the data are determined to be speech according to the additional data, the data by using a first decoding scheme and changing the quality of the decoded data using a first signal processing method, which is at least one of a plurality of first signal post-processing schemes;

decoding, when the attributes of the data are determined to be music according to the additional data, the data using a second decoding scheme, which is different than the first decoding scheme, and changing the quality of the decoded data by using a second signal processing method, which is at least one of a plurality of second signal post-processing schemes, wherein the second signal processing method is different than the first signal processing method; and outputting, through a speaker, an audio signal corresponding to the data changed using the first signal processing method or the second signal processing method, wherein the plurality of first signal post-processing schemes includes a scheme for reducing or removing noise from the decoded data, a scheme for removing a low-band portion of the frequency domain of the decoded data, and a scheme for adjusting the dynamics of the decoded data.

5. The method of claim 4, wherein receiving the data from the external electronic device comprises receiving the data during a call connection with the external electronic device.

6. The method of claim 4, wherein the plurality of second signal post-processing schemes includes a FENS scheme which does not remove noise or lower the noise when the audio signal corresponds to music, a cut off scheme for lowering cut-off when the audio signal corresponds to music, and an adjustment method for adjusting AGC attack/release time according to the music when the audio signal corresponds to music.

7. A non-transitory computer readable recording medium in which a program for executing operations is recorded, the operations comprising:

receiving data and additional data from an external electronic device, the additional data indicating attributes of the data;

when the attributes of the data are determined to be speech according to the additional data, decoding the data by using a first decoding scheme and changing the speech quality of the decoded data by using a first signal processing method, which is at least one of a plurality of first signal post-processing schemes;

when the attributes of the data are determined to be music according to the additional data, decoding the data using a second decoding scheme, which is different than the first decoding scheme, and changing the quality of the decoded data using a second signal processing method, which is at least one of a plurality of second signal post-processing schemes, wherein the second signal processing method is different than the first signal processing method; and outputting, through an output device, an audio signal corresponding to the data changed using the first signal processing method or the second signal processing method, wherein the plurality of first signal post-processing schemes include a scheme for reducing or removing noise from the decoded data, a scheme for removing a low-band portion of the frequency domain of the decoded data, and a scheme for adjusting dynamics of the decoded data.

8. A non-transitory computer readable recording medium in which a program for executing operations is recorded, the operations comprising:

receiving an audio signal from an input device;

generating data and additional data corresponding to the audio signal, the additional data indicating attributes of the data;

determining attributes of the audio signal at least partially based on the data;

changing, when the attributes of the audio signal are determined to be speech according to the additional data, the quality of the data using a first signal processing method, which is at least one of a plurality of first signal pre-processing schemes, and encoding the changed data using a first coding scheme;

changing, when the attributes of the audio signal are determined to be music according to the additional data, the quality of the data using a second signal processing method, which is at least one of a plurality of second signal pre-processing schemes, and encoding the changed data using a second coding scheme, which is different than the first coding scheme, wherein the second signal processing method is different than the first signal processing method; and transmitting, to an external electronic device through a communication module, the audio signal which has been encoded using the first coding scheme or the second coding scheme, wherein the plurality of first signal pre-processing schemes include a scheme for removing surrounding noise from the data, a scheme for improving articulation of the data, a scheme for removing residual noise from the data, a scheme to which anti-clipping compression is applied.

9. An electronic device comprising:

a speaker;

a communication module configured to communicate with an external electronic device; and a processor connected to the communication module, wherein the processor is configured to:

receive data and additional data from the external electronic device using the communication module, the additional data indicating attributes of the data;

when the attributes of the data is determined as speech according to the additional data, decode the data using a first decoding scheme and change the quality of the decoded data using a first signal processing scheme, which is at least one of a plurality of first signal post-processing schemes;

when the attributes of the data is determined as music according to the additional data, decode the data using a second decoding scheme, which is different than the first decoding scheme, and change the quality of the decoded data by using a second signal processing scheme, which is at least one of a plurality of second signal post-processing schemes, wherein the second signal processing scheme is different than the first signal processing scheme; and output, through the speaker, an audio signal corresponding to the data changed using the first signal processing scheme or the second signal processing scheme, wherein the plurality of first signal post-processing schemes includes a far-end noise suppression (FENS) scheme for reducing or removing noise from the decoded data, a cut off scheme for removing a low-band portion of the frequency domain of decoded data, and an AGC scheme for constantly adjusting the dynamics of the decoded data.

10. A method of comprising:

receiving data and additional data from an external electronic device, the additional data indicating attributes of the data;

decoding, when the attributes of the data is determined as speech according to the additional data, the data by using a first decoding scheme and changing the quality of the decoded data using a first signal processing method, which is at least one of a plurality of first signal post-processing schemes;

decoding, when the attributes of the data is determined as music according to the additional data, the data using a second decoding scheme, which is different than the first decoding scheme, and changing the quality of the decoded data by using a second signal processing method, which is at least one of a plurality of second signal post-processing schemes, wherein the second signal processing method is different than the first signal processing method; and outputting, through a speaker, an audio signal corresponding to the data changed using the first signal processing method or the second signal processing method, wherein the plurality of first signal post-processing schemes includes a far-end noise suppression (FENS) scheme for reducing or removing noise from the audio signal on the reception side, a cut off scheme for removing a low-band portion of the frequency domain of an audio signal, and an AGC scheme for constantly adjusting the dynamics of the audio signal.

11. An electronic device comprising:

a microphone;

a communication module configured to communicate with an external electronic device; and a processor connected to the communication module, wherein the processor is configured to:

receive an audio signal through the microphone;

generate data and additional data corresponding to the audio signal, the additional data indicating attributes of the audio signal;

determine the attributes of the audio signal at least partially based on the additional data;

change quality of the data using a first signal processing method, which is at least one of a plurality of first signal pre-processing schemes, and encode the changed data using a first coding scheme when the attributes of the audio signal are determined to be speech according to the additional data;

change the quality of the data using a second signal processing method, which is at least one of a plurality of second signal pre-processing schemes, and encode the changed data using a second coding scheme, which is different than the first coding scheme, when the attributes of the audio signal are determined to be music according to the additional data, wherein the second signal processing method is different than the first signal processing method; and transmit, to the external electronic device through the communication module, the audio signal which has been encoded using the first coding scheme or the second coding scheme, wherein the plurality of first signal pre-processing schemes include a scheme for removing surrounding noise from the data, a scheme for improving articulation of the data, a scheme for removing residual noise from the data, and a scheme in which anti-clipping compression is applied.

12. The electronic device of claim 11, wherein the processor is further configured to transmit the data during a call connection with the external electronic device.

13. A method comprising:

receiving an audio signal from an input device;

generating data and additional data corresponding to the audio signal, the additional data indicating attributes;

determining attributes of the audio signal at least partially based on the data;

changing, when the attributes of the audio signal are determined to be speech according to the additional data, the quality of the data using a first signal processing method, which is at least one of a plurality of first pre-processing schemes, and encoding the changed data using a first coding scheme;

changing, when the attributes of the audio signal are determined to be music according to the additional data, the quality of the data using a second signal processing method, which is at least one of a plurality of second signal pre-processing schemes, and encoding the changed data using a second coding scheme, which is different than the first coding scheme, wherein the second signal processing method is different than the first signal processing method; and transmitting, to an external electronic device through a communication module, the audio signal which has been encoded using the first coding scheme or the second coding scheme, wherein the plurality of first signal pre-processing schemes include a scheme for removing surrounding noise from the data, a scheme for improving articulation of the data, a scheme for removing residual noise from the data, a scheme in which anti-clipping compression is applied.

14. The method of claim 13, wherein transmitting the audio signal to the external electronic device through the communication module comprises transmitting the data during a call connection with the external electronic device.

* * * * *